US007040994B2

(12) United States Patent
Lochtefeld et al.

(10) Patent No.: US 7,040,994 B2
(45) Date of Patent: May 9, 2006

(54) REDUNDANT ARRAY WATER DELIVERY SYSTEM FOR WATER RIDES

(75) Inventors: Thomas J. Lochtefeld, La Jolla, CA (US); Jeffery W. Henry, New Braunfels, TX (US)

(73) Assignee: Light Wave, Ltd., Reno, NV (US)

( * ) Notice: Subject to any disclaimer, the term of this patent is extended or adjusted under 35 U.S.C. 154(b) by 0 days.

(21) Appl. No.: 11/207,538

(22) Filed: Aug. 19, 2005

(65) Prior Publication Data

US 2005/0274420 A1 Dec. 15, 2005

Related U.S. Application Data

(63) Continuation of application No. 10/855,954, filed on May 27, 2004, now Pat. No. 6,957,662, which is a continuation of application No. 09/334,736, filed on Jun. 17, 1999, now Pat. No. 6,758,231.

(60) Provisional application No. 60/089,542, filed on Jun. 17, 1998.

(51) Int. Cl.
*E03B 11/00* (2006.01)
*E03B 3/18* (2006.01)

(52) U.S. Cl. ..... 472/117; 472/128; 137/545; 137/550; 137/565.3; 137/565.33; 104/70

(58) Field of Classification Search ..... 137/565.33, 137/565.3, 545, 550; 104/70; 472/117, 472/128

See application file for complete search history.

(56) References Cited

U.S. PATENT DOCUMENTS

| | | | | |
|---|---|---|---|---|
| 1,828,696 | A | | 10/1931 | Woodford |
| 3,452,519 | A | | 7/1969 | Bianchetta |
| 3,598,402 | A | | 8/1971 | Frenzi |
| 3,726,606 | A | | 4/1973 | Peters |
| 3,830,161 | A | | 8/1974 | Bacon |
| 3,835,478 | A | | 9/1974 | Molus |
| 3,853,067 | A | | 12/1974 | Bacon |
| 3,923,301 | A | | 12/1975 | Myers |
| 3,923,423 | A | | 12/1975 | Lauck |
| 4,149,710 | A | | 4/1979 | Rouchard |
| 4,194,733 | A | | 3/1980 | Whitehouse, Jr. |
| 4,196,900 | A | | 4/1980 | Becker et al. |
| 4,198,043 | A | | 4/1980 | Timbes et al. |
| 4,304,105 | A | | 12/1981 | West |
| D269,104 | S | | 5/1983 | Brown |
| 4,392,434 | A | | 7/1983 | Durwald et al. |
| 4,559,963 | A | * | 12/1985 | Sugisawa et al. ..... 137/1 |
| 4,564,190 | A | | 1/1986 | Frenzl |
| 4,778,430 | A | | 10/1988 | Goldfarb et al. |
| 4,787,822 | A | | 11/1988 | Bennett |

(Continued)

FOREIGN PATENT DOCUMENTS

CA 1204629 9/1970

*Primary Examiner*—A. Michael Chambers
(74) *Attorney, Agent, or Firm*—Knobbe, Martens, Olson & Bear, LLP

(57) ABSTRACT

A redundant array pumping system and control system is provided for water rides for ensuring continuous and non-disruptive supply of water. The pumping system incorporates a redundant pump and filter array in conjunction with a nozzle system for injecting water onto a ride surface. The nozzle system may incorporate a plurality of redundant or quasi-redundant nozzles. The hydraulic system can include many levels of redundancy as applied to its various components, such as pumps, filters and nozzles. Additionally, the system can be equipped with a plurality of pressure and flow sensors for monitoring and controlling the performance of the pumps, filters and nozzles of the hydraulic system.

38 Claims, 22 Drawing Sheets

U.S. PATENT DOCUMENTS 4,799,864 A * 1/1989 Hockley ..... 417/7
4,805,896 A 2/1989 Moody
4,805,897 A 2/1989 Dubeta
4,836,521 A 6/1989 Barber
4,905,987 A 3/1990 Frenzi
5,011,134 A 4/1991 Langford
5,213,547 A 5/1993 Lochtefeld
5,453,054 A 9/1995 Lanford
5,477,882 A * 12/1995 Duthie ..... 137/565.19
5,498,105 A 3/1996 Takada et al.
5,566,709 A 10/1996 Fujii et al.
6,758,231 B1 7/2004 Lochtefeld et al.

* cited by examiner

* RESERVE PUMP WILL BE USED TO POWER RIVER ACCELERATOR AT NIGHT, WHEN TORRENT POWER IS OFF

FILTER
VALVE
PUMP 94
12
20
16
22
18
PMV1
FCV1
FNV1
P1
PV1
SV1
F1
FV1
PMV2
FCV2
FMV2
P2
PV2
SV2
F2
FV2
PMV3
FCV3
FMV3
P3
PV3
SV3
F3
FV3
PMV4
FCV4
FMV4
P4
PV4
SV4
F4
FV4
PMV5
FCV5
FMV5
P5
PV5
SV5
F5
FV5
PMV6
FCV6
FMV6
P6
PV6
SV6
F6
FV6
PMV7
FCV7
FMV7
P7
PV7
SV7
F7
FV7
PMV8
FCV8
FMV8
P8
PV8
SV8
F8
FV8
PMV9
FCV9
FMV9
P9
PV9
SV9
F9
FV9
PMV10
FCV10
FMV10
P10
PV10
SV10
F10
FV10
PMV11
FCV11
FMV11
P11
PV11
SV11
F11
FV11
PMV12
FNV12
AFV13
P12
32
SV12
APV13
F12
10

FILTER
VALVE OPEN
VALVE CLOSED
PUMP 94
12
20
16
13
22
18
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
AFV12
AFV13
P12
SV12
APV13
32
F12
10

FILTER
VALVE OPEN
VALVE CLOSED
PUMP 94
12
20
16
13
22
18
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
AFV12
AFV13
P12
SV12
APV13
32
F12
10

FILTER
VALVE OPEN
VALVE CLOSED
PUMP 94
12'
20
16'
13'
22
18'
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11'
N11
FMV11
P11
PV11
SV11
F11
FV11
PMV12
AFV12
AFV13
P12
SV12
APV13
F12
32
AFV13'
SV13
F12'
10'

FILTER
VALVE OPEN
VALVE CLOSED
PUMP 94
12
20
16"
22
18"
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
FMV12
P12
32
SV12
FV12
AV1
F12
10"

FILTER
VALVE OPEN
VALVE CLOSED
PUMP 94
12
20
16"
22
18"
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
FMV12
P12
32
SV12
FV12
AV1
F12
10"

FILTER
VALVE OPEN
VALVE CLOSED
PUMP 94
12
20
16"
22
18"
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
FMV12
P12
32
SV12
FV12
AV1
F12
10'

FILTER
VALVE OPEN
VALVE CLOSED
PUMP 94
12
20
16"
18"
22
PMV1
FCV1
N1
FNV1
P1
PV1
SV1
F1
FV1
PMV2
FCV2
N2
FMV2
P2
PV2
SV2
F2
FV2
PMV3
FCV3
N3
FMV3
P3
PV3
SV3
F3
FV3
PMV4
FCV4
N4
FMV4
P4
PV4
SV4
F4
FV4
PMV5
FCV5
N5
FMV5
P5
PV5
SV5
F5
FV5
PMV6
FCV6
N6
FMV6
P6
PV6
SV6
F6
FV6
PMV7
FCV7
N7
FMV7
P7
PV7
SV7
F7
FV7
PMV8
FCV8
N8
FMV8
P8
PV8
SV8
F8
FV8
PMV9
FCV9
N9
FMV9
P9
PV9
SV9
F9
FV9
PMV10
FCV10
N10
FMV10
P10
PV10
SV10
F10
FV10
PMV11
FCV11
N11
FMV11
P11
PV11
SV11
F11
FV11
PMV12
FMV12
P12
32
SV12
FV12
AV1
F12
10'

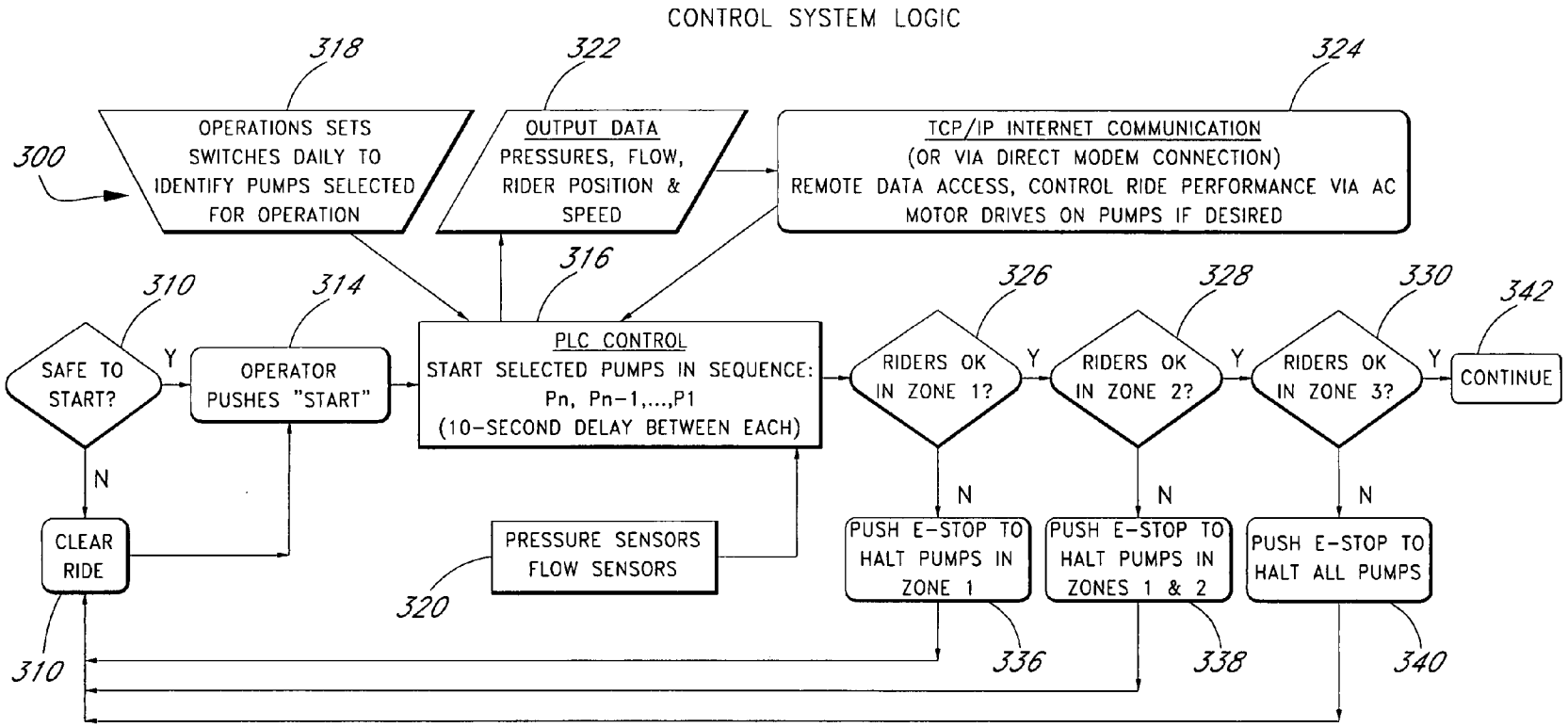

FIG. 15

NOTES:

1. PUMP Pn IS CONNECTED TO NOZZLE AT END OF RIDE.
2. PUMP P1 IS CONNECTED TO NOZZLE AT BEGINNING OF RIDE.
3. OPERATIONS CAN SELECT WHICH PUMPS ARE TO BE OPERATIONAL, INCLUDING A BOOSTER PUMP IF REQUIRED.
4. PUMPS CAN BE EQUIPPED WITH VARIABLE SPEED AC DRIVES TO OPTIMIZE PERFORMANCE.
5. IF ZONE 1 MUST BE STOPPED, ZONE 2 & 3 CAN CONTINUE RUNNING TO ALLOW THOSE RIDERS TO COMPLETE RIDE.
6. IF ZONE 2 MUST BE STOPPED, BOTH ZONES 1 & 2 STOP. ZONE 3 CONTINUES TO RUN.
7. IF ZONE 3 MUST BE STOPPED, ALL ZONES SHUT DOWN.
8. THIS LOGIC IS DESIGNED TO PREVENT UPHILL RIDERS FROM IMPACTING DOWNHILL RIDERS THAT HAVE BEEN STOPPED.
9. INTERNET OR DIRECT MODEM CONNECTION ALLOWS REMOTE MONITORING AND LIMITED CONTROL.
10. RIDER POSITION SENSORS CAN MONITOR SPEED AND POTENTIALLY ENABLE PLC TO AUTO STOP RIDE IF OPERATOR FAILS TO NOTICE STOPPED RAFT/RIDER.

REDUNDANT ARRAY WATER DELIVERY SYSTEM FOR WATER RIDES

RELATED APPLICATION

This application is a continuation of U.S. application Ser. No. 10/855,954, which was filed on May 27, 2004, now U.S. Pat. No. 6,957,662 which is a continuation of U.S. application Ser. No. 09/334,736, which was filed on Jun. 17, 1999, now U.S. Pat. No. 6,758,231, which claims priority to U.S. application Ser. No. 60/089,542, which was filed on Jun. 17, 1998. The entirety of each of these applications is hereby incorporated by reference.

BACKGROUND OF THE INVENTION

1. Field of the Invention

The present invention relates generally to water rides, and, more particularly to a redundant array pumping system and associated control and diagnostics for water rides of the type incorporating one or more high speed water jets for transferring kinetic energy to ride participants and/or ride vehicles riding/sliding on a low-friction slide or other ride surface.

2. Description of the Related Art

The past two decades have witnessed a phenomenal proliferation of family water recreation facilities, such as family waterparks and water oriented attractions in traditional themed amusement parks. Typical mainstay water ride attractions include waterslides, river rapid rides, and log flumes. These rides allow riders to slide down (either by themselves or via a ride vehicle) a slide or chute from an upper elevation or starting point to a lower elevation, typically a splash pool. Gravity or gravity induced rider momentum is the prime driving force that powers participants down and through such traditional water ride attractions.

U.S. Pat. No. 4,198,043 to Timbes, for example, discloses a typical gravity-induced water slide wherein a rider from an upper start pool slides by way of gravity to a lower landing pool. Similarly, U.S. Pat. No. 4,196,900 to Becker discloses a conventional downslope waterslide with water recirculation provided. In each case, water is provided on the ride surface primarily as a lubricant between the rider and the ride surface and/or to increase the fun and enjoyment of the ride such as by splashing water.

A more recent phenomenon are the so-called "injected sheet flow" water rides. These rides typically employ one or more high-pressure injection modules which inject a sheet or jet of high-speed water onto a ride surface to propel a participant in lieu of, or in opposition to, or in augmentation with the force of gravity. The location and configuration of the nozzles and the velocity and volume of the injected flow prescribes the resultant water flow pattern and user path/velocity for a particular ride. A wide variety of fun and entertaining water rides and ride configurations are possible using injected sheet flow technology.

For example, one such injected sheet flow water ride is sold and marketed under the name Master Blaster®, and is available from NBGS of New Braunfels, Tex. The Master Blaster® ride attraction is also sometimes referred to as a "water coaster" style water ride because it provides essentially the water equivalent of a roller coaster ride. In particular, it has both downhill and/or uphill portions akin to a conventional roller-coaster and it also powers ride participants up at least one incline.

In a typical water coaster style water ride high-pressure water injection nozzles are located along horizontal and/or uphill portions of the ride to provide high-speed jets which propel the participant in the absence of or in addition to any gravity-induced rider momentum. Such high speed jets can also be used to accelerate participants horizontally or downhill at a velocity that is greater than can be achieved by gravity alone. High speed jets can also be used to slow down and/or regulate the velocity of ride participants on a ride surface so as to prevent a ride participant from achieving too much velocity or becoming airborne at an inopportune point in the ride. See, for example, U.S. Pat. No. 5,213,547, which is incorporated herein by reference.

Another popular water ride of the injected sheet flow variety is the sheet flow simulated wave water ride. For example, one such simulated wave water ride is sold and marketed under the name Flow Rider®, and is available from Wave Loch, Inc. of La Jolla, Calif. The Flow Rider® simulated wave water ride includes a sculptured padded ride surface having a desired wave-simulating shape upon which one or more jets of high-speed sheet water flow are provided. The injected sheet water flow is typically directed up the incline, thereby simulating the approaching face of an ideal surfing wave. The thickness and velocity of the sheet water flow is such that it creates simultaneously a hydroplaning or sliding effect between the ride surface and the ride participant and/or vehicle and also a drag or pulling effect upon a ride participant and/or ride vehicle hydroplaning upon the sheet flow. By carefully balancing the upward-acting drag forces and the downward-acting gravitational forces, skilled ride participants are able to ride upon the injected sheet water flow and perform surfing-like water skimming maneuvers thereon for extended periods of time, thereby achieving a simulated and/or enhanced surfing wave experience. See, for example, U.S. Pat. No. 5,401,117, which is incorporated herein by reference.

In each of the injected sheet flow water rides described above, water is injected onto the ride surface by a high-pressure pumping system connected to one or more flow forming nozzles located at various positions along or adjacent to the ride surface. The pumping system serves as the primary driving mechanism and generates the necessary head or water pressure needed to deliver the required quantity and velocity of water from the various flow forming nozzles. Conventionally the pumping system comprises a bank of pumps with each pump providing water to a single nozzle located at a particular position along or adjacent to the ride surface. Where a series of nozzles are connected together, it is also known to use a single pump with a suitable manifold to provide the requisite water to each nozzle. The particular configuration and number of pumps chosen for a given system is typically dictated by factors such as the cost and pumping capacity of each pump, the size and nature of the particular ride and the type of ride effect desired. Typically, the suction end of each pump is connected to a water filter, which, in turn, is linked to a water reservoir or sump.

Occasionally, however, it has been observed that one of the pumps in the water ride pumping system will fail or become sufficiently impaired such that it is no longer able to function at the required capacity and/or head. In such cases, the pump may have to be shut-off for replacement or repair. Similarly, an associated filter or nozzle may become congested or clogged such that the required flow rate is not achieved. In such cases the whole water ride is adversely affected and is typically required to be shut down to facilitate service and/or repair of the malfunctioning component.

This is an undesirable and disadvantageous situation because ride patrons may become upset or impatient waiting for the ride to be repaired and restarted. Also, patrons on the ride during a forced shut-down may be effectively stranded on the ride for some time while the affected components are being serviced and/or replaced. Excessive down-time can lead to lower overall rider throughput and, therefore, reduced profits for the ride owner/operator. For certain water rides there can also be safety implications if one or more of the injection nozzles should suffer a sudden collapse of water pressure due to pump failure or the like. For example, in water coaster type rides with both uphill and downhill portions, the sudden loss of localized nozzle water pressure on an uphill portion could possibly cause a ride participant(s) to stall and possibly fall back and collide with other ride participants entering the uphill portion, for example.

It would be a significant advance and commercial advantage in the industry if such disadvantages could be overcome or mitigated.

SUMMARY OF THE INVENTION

Accordingly, it is a principal object and advantage of the present invention to overcome some or all of these limitations and to provide a redundant array pumping system and an associated control and diagnostics system for water rides of the type in which ride participants and/or ride vehicles ride/slide on a low-friction slide or other ride surface.

In accordance with one embodiment, the present invention provides a redundant array pumping system including a redundant pump array and a redundant filter array for ensuring uninterrupted water supply to an associated water ride. The redundant array pumping system preferably includes at least one primary pump and at least one auxiliary pump. Similarly, the redundant filter system preferably includes at least one primary filter and at least one auxiliary filter. In another embodiment, a nozzle system incorporates a plurality of quasi-redundant nozzles with each nozzle having a plurality of primary jets and at least one reserve jet. Each primary pump draws water from a water reservoir or sump via each respective primary filter and provides water to each respective nozzle. The nozzles are preferably spaced and positioned at predetermined locations along the water ride.

The pumps of the redundant array pumping system are preferably coupled by employing a pump bypass manifold. The redundant pumping system is preferably disposed with valve means, comprising manual or automated valves. The valve means permit looping out and looping in of each primary and auxiliary pump. Advantageously, this allows a primary pump to be isolated for inspection, servicing, repair or replacement while an auxiliary pump serves as a substitute, thereby ensuring that the water ride continues smooth and non-disruptive operation.

Similarly, the filters of the redundant filter array are preferably coupled by employing a filter bypass manifold. The redundant filter system is preferably disposed with valve means, comprising manual or automated valves. Again, the valve means permit looping out and looping in of each primary and auxiliary filter. Advantageously, this allows a primary filter to be isolated for inspection, servicing, repair or replacement while an auxiliary filter serves as a substitute, thereby ensuring that the water ride continues smooth and non-disruptive operation.

In some embodiments, each jet of a quasi-redundant nozzle is coupled with flow control means, such as manual or automated flow control valves. Also, the jets forming a particular nozzle are preferably substantially closely spaced. Thus, if a primary jet is partially blocked, the associated flow control means can possibly be adjusted to compensate for the blockage. If the blockage is severe, the flow control means for an adjacent reserve jet can be adjusted to compensate for the blockage of the blocked reserve jet, thereby advantageously ensuring that the water ride continues to operate smoothly and with minimal effect on its quality.

In another preferred embodiment of the present invention, a plurality of pumps can be added in parallel to each one or some of the primary and auxiliary pumps. Thus, one or more of the plurality of pumps in parallel may serve in an auxiliary capacity along with or without the auxiliary pump(s) already present in the first-mentioned preferred embodiment. Similarly, a plurality of filters can be added in parallel to each one or some of the primary and auxiliary filters. Thus, one or more of the plurality of filters in parallel may serve in an auxiliary capacity along with or without the auxiliary filter(s) already present in the first-mentioned preferred embodiment. Advantageously, this adds an extra degree of redundancy to the water ride hydraulic system.

In yet another preferred embodiment, each or some primary pumps feed into a plurality of jets with each jet being part of a separate nozzle. Preferably, these nozzles are substantially closely spaced one behind the other and include primary and reserve jets which have associated flow control means, such as manual or automated flow control valves. In the case of jet blockage, appropriate adjacent reserve jets are activated by adjusting the flow control means to provide sufficient water to the water ride. Advantageously, this quasi-redundant nozzle configuration permits nozzle quasi-redundancy in two dimensions.

* [Insert Claim Summaries]*

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Those of ordinary skill in the art will readily recognize the advantages and utility of the present invention from the detailed description provided herein having reference to the appended figures, of which:

FIG. 15 is a simplified control system logic diagram of a diagnostic and control system for a water ride having features and advantages in accordance with the present invention.

DETAILED DESCRIPTION OF THE PREFERRED EMBODIMENT

Figure 1:
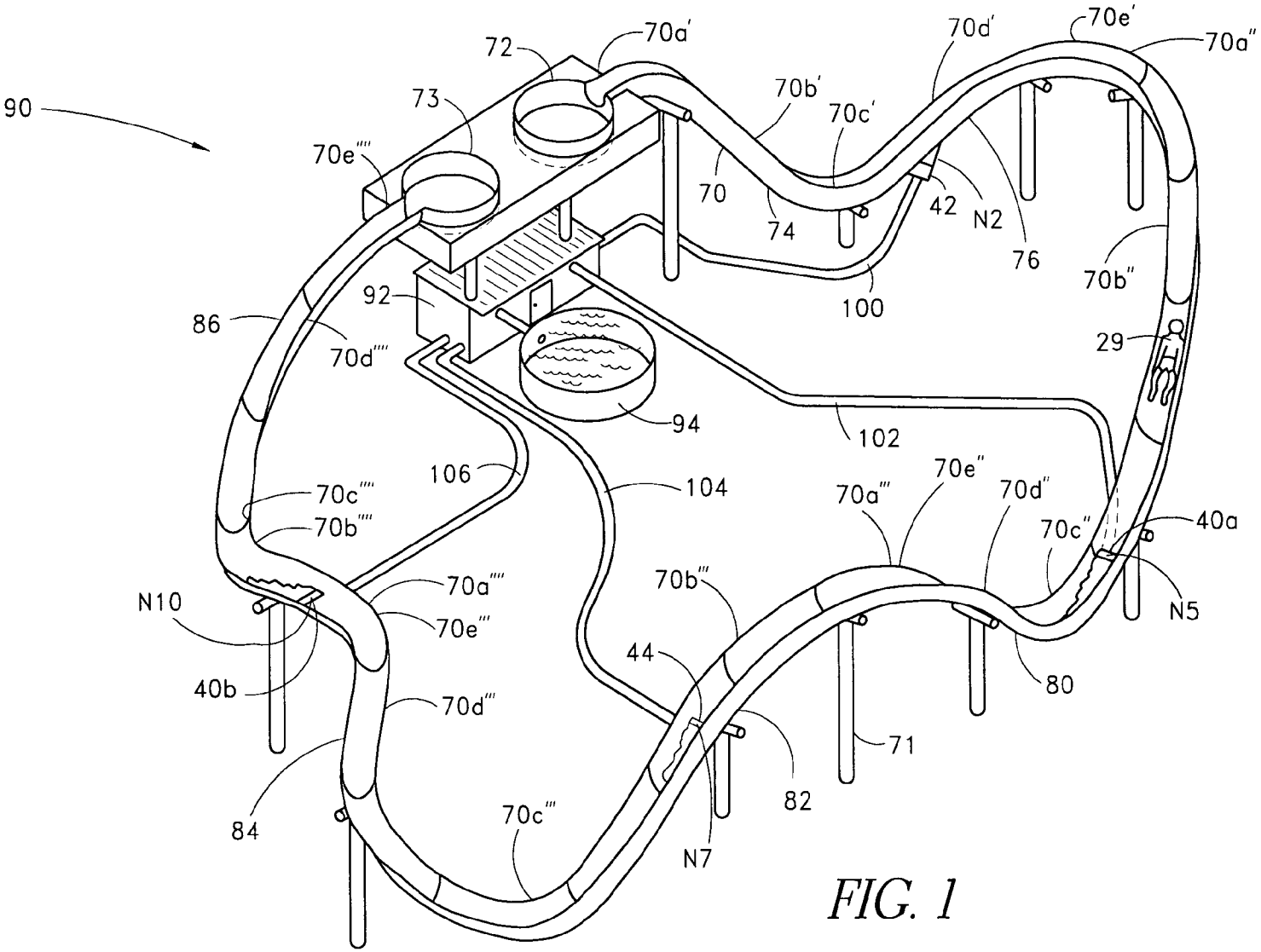
FIG. 1 is a perspective schematic view of one embodiment of an injected sheet water ride having features and advantages in accordance with the present invention.

For purposes of illustration and ease of understanding, the present invention is discussed primarily in the context of a water coaster style water ride, such as illustrated in FIG. 1. However, it should be recognized that some or all of the elements of the invention taught herein may also be used efficaciously for controlling other types of rides having multiple water injection nozzles, such as simulated wave water rides, flume rides, and the like.

FIG. 1 is a simplified schematic of a water-coaster style water ride 90 having features in accordance with the present invention. Water Coaster 90 commences with a conventional start basin 72, which allows ride participants 29 to enter the ride. The ride generally comprises a ride surface 70 forming a channel. The ride surface 70 may be made of any number of suitable materials, for example, resin impregnated fiberglass, concrete, gunite, sealed wood, vinyl, acrylic, metal or the like, which can be made into segments and joined by appropriate water-tight seals in end to end relation. Ride surface 70 is supported by suitable structural supports 71, for example, wood, metal, fiberglass, cable, earth, concrete or the like.

Ride attraction surface 70, although continuous, may be sectionalized for the purposes of description into a first horizontal top of a downchute portion 70*a*' to which conventional start basin 72 is connected, a first downchute portion 70*b*', a first bottom of downchute portion 70*c*', a first rising portion 70*d*' that extends upward from the downchute bottom 70*c*', and a first top 70*e*' of rising portion 70*d*'. Thereafter, attraction surface 70 continues into a second top of downchute portion 70*a*", a second downchute portion 70*b*", a second bottom of downchute portion 70*c*", a second rising portion 70*d*" that extends upward from downchute bottom 70*c*", and a second top 70*e*" of rising portion 70*d*". Thereafter, attraction surface 70 continues into a third top of downchute portion 70*a*'", a third downchute portion 70*b*'", a third bottom of downchute portion 70*c*'", a third rising portion 70*d*'" that extends upward from downchute bottom 70*c*'", and a third top 70*e*'" of rising portion 70*d*'". Thereafter, attraction surface 70 continues into a fourth top of downchute portion 70*a*"", a fourth downchute portion 70*b*"", a fourth bottom of downchute portion 70*c*"", a fourth rising portion 70*d*"" that extends upward from downchute bottom 70*c*"", and a fourth top 70*e*"" of rising portion 70*d*"" which connects to ending basin 73 in an area adjacent start basin 72 and the first top of downchute portion 70*a*'.

An upward accelerator module 42 is located in an upward portion 70*d*' of the attraction surface 70. A horizontal accelerator 40*a* is located in attraction surface 70 at the second bottom of the downchute portion 70*c*". A downward accelerator 44 is located in attraction surface 70 at third downchute portion 70*b*'". A second horizontal accelerator 40*b* is located in attraction surface 70 at the fourth top of downchute portion 70*a*"". The various accelerator modules are adapted to inject a sheet flow of water onto the ride surface 70 to propel a rider and/or ride vehicle thereon. Overflow water, whitewater (i.e. splash) and rider transient surge build up is eliminated by venting the slowed water over the outside edge of the riding surface, or through openings provided along the bottom and/or side edges of the channel, See, e.g., U.S. Pat. No. 5,213,547 incorporated herein by reference. Water to the various accelerator modules 40, 42, 44 and to start basin 72 is provided via a high pressure source described in more detail later.

Figure 2A:
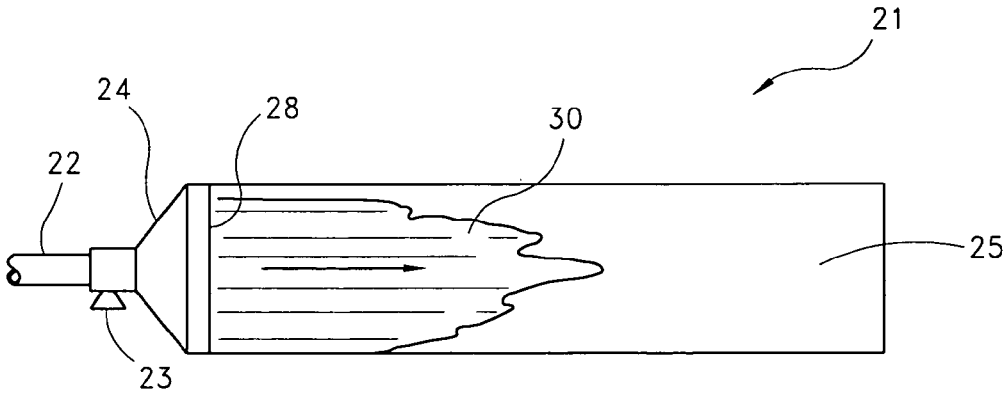
FIG. 2*a* is a top view of a propulsion module for use in accordance with the injected sheet water ride of FIG. 1.
Figure 2B:
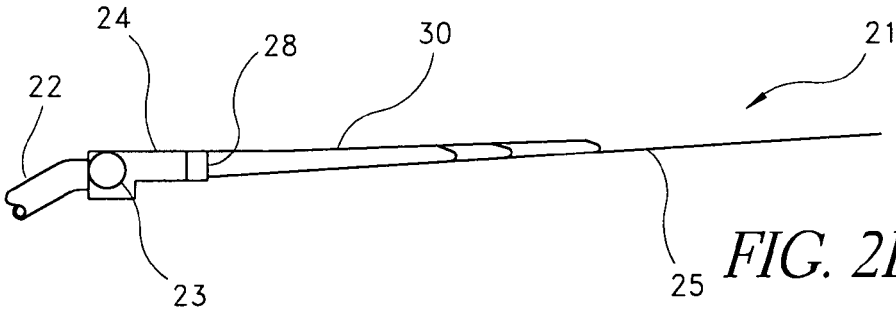
FIG. 2*b* is a side view of the propulsion module of FIG. 2*b;*

Turning now to FIG. 2A (top view) and FIG. 2B (side view) there is illustrated a propulsion module 21 comprising a high flow/high pressure water source 22; a flow control valve 23; a flow forming nozzle 24 with adjustable aperture 28; all of which work together to form a discrete jet-water flow 30 with arrow indicating the predetermined direction of motion. The aperture 28 of the flow-forming nozzle 24 preferably has an elongated rectangular shape, as shown, so as to extrude a sheet-like jet of water. The aperture may be sized from about ½ cm×20 cm to about 40 cm×200 cm in height and width, respectively. Alternatively, other shapes and sizes may be used with efficacy.

The propulsion module further includes a substantially smooth segment of riding surface 25 over which jet-water flow 30 flows. Riding surface 25 preferably has sufficient structural integrity to support the weight of a human rider(s), vehicle, and water moving thereupon. It is also preferred that riding surface 25 have a low-coefficient of friction to enable jet-water 30 to flow and rider 29 to move with minimal loss of speed due to drag. Module 21 may be fabricated using of any number of suitable materials, for example, resin impregnated fiberglass, concrete, gunite, sealed wood, vinyl, acrylic, metal or the like, and is joined by appropriate water-tight seals in end to end relation.

Figure 2C:
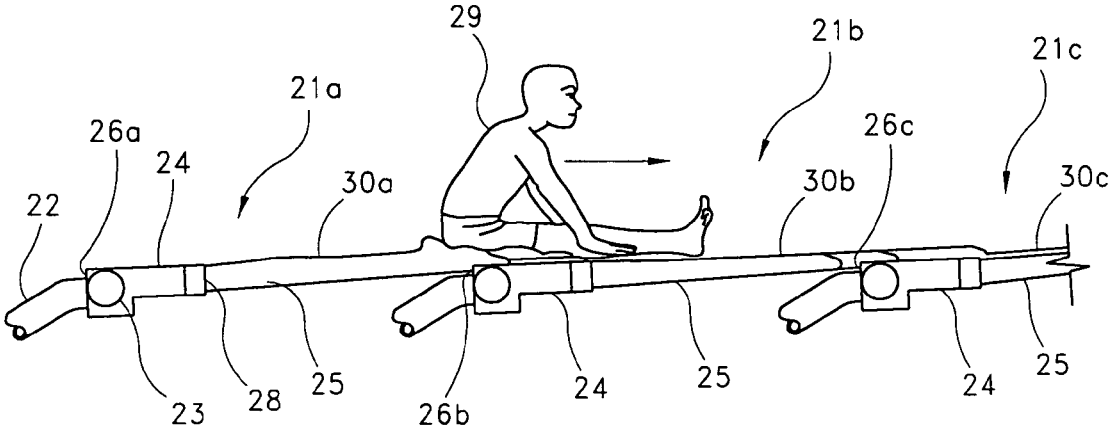
FIG. 2*c* is a side view of a series of connected propulsion modules illustrating a rider thereon.

FIG. 2C (side view) depicts a rider 29 (with arrow indicating the predetermined direction of motion) sliding upon a series of connected modules 21*a*, 21*b*, 21*c*. Connections 26*a*, 26*b* and 26*c* between modules 21*a*, 21*b*, and 21*c* permit any desired degree of increase in overall length of the connected propulsion modules, as operationally, spatially, and financially desired. Connection 26 can result from bolting, gluing, or continuous casting of module 21 in an end to end fashion. When connected, the riding surface 25 of each module is preferably substantially in-line with and flush to its connecting module to permit a rider 29 who is sliding thereon and the jet-water 30 which flows thereon to respectively transition in a safe and smooth manner. When a module has nozzles 24 that emerge from a position along the length of the riding surface 25 (as depicted in FIG. 1C), it is preferred that the non-nozzle end of the riding surface 25 extend to and overlap the top of a connecting nozzle 24 at connection 26. Further to this configuration, it is also preferred that the bottom of nozzle 24 extend and serve as riding surface 25.

The length of each propulsion module 21 can vary depending on desired operational performance characteristics and desired construction techniques or shipping parameters. Module 21 width can be as narrow as will permit one participant to ride in a seated or prone position with legs aligned with the direction of water flow, roughly 50 cm (20 inches), or as wide as will permit multiple participants to simultaneously ride abreast in a passenger vehicle or innertube.

Each nozzle 24 is formed and positioned to emit jet-water flow 30 in a direction substantially parallel to and in the lengthwise direction of riding surface 25 through adjustable aperture 28. To enable continuity in rider throughput and water flow, when modules are connected in series for a given attraction (e.g., FIG. 2*c*), all nozzles are preferably aligned in the same relative direction to augment overall momentum transfer and rider movement. The condition of jet-water flow 30 (i.e., temperature, turbidity, pH, residual chlorine count, salinity, etc.) is standard pool, lake, or ocean condition water suitable for human swimming.

Figure 3A:
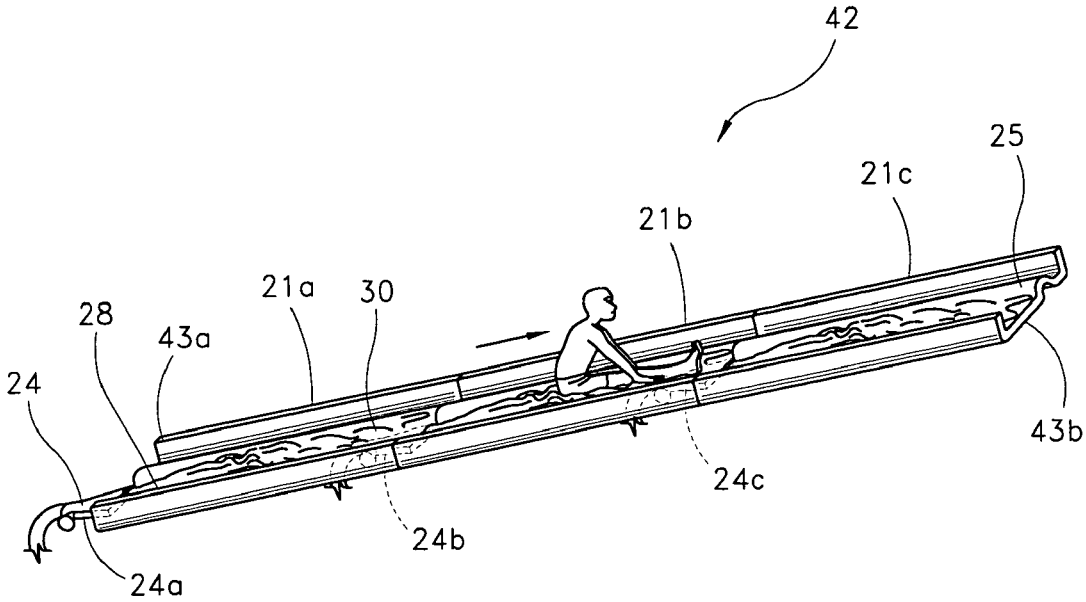
FIG. 3*a* is a side perspective view of an upward accelerator incorporating multiple connected propulsion modules and illustrating a rider thereon.
Figure 3B:
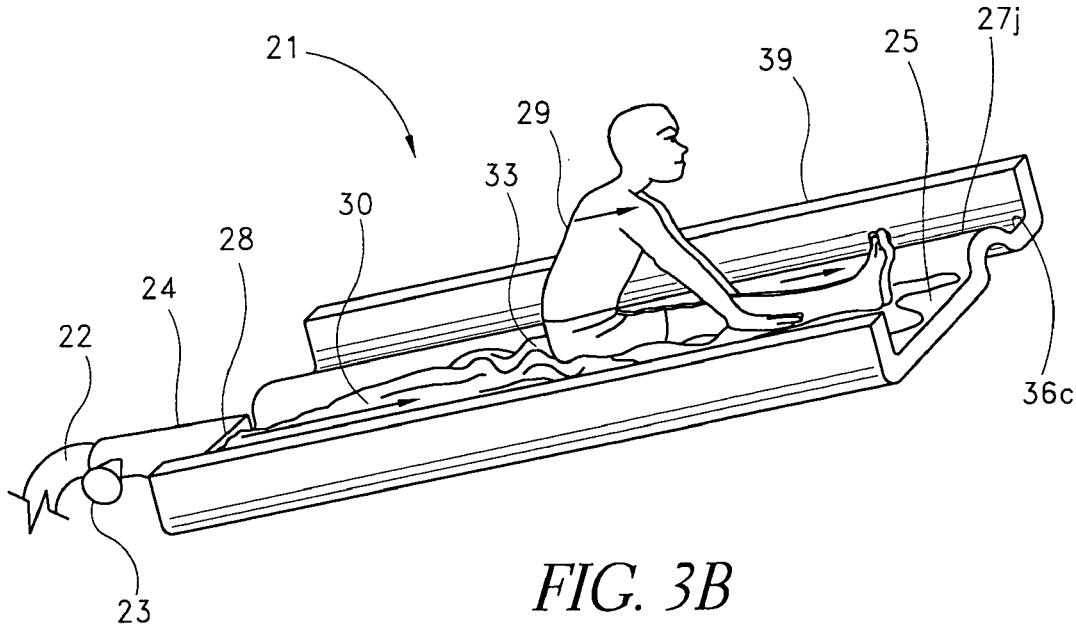
FIG. 3*b* is a side perspective view of one of the connected propulsion modules of FIG. 3*a* and illustrating a rider thereon.

FIGS. 3*a*, 3*b* illustrate the use and operation of an upward accelerator 42 for propelling a rider 29 along a portion of ride surface 25 from a lower elevation to a higher elevation. A rider 29 enters the accelerator module 21 at the end nearest nozzle 24 and moves upward along its length as shown in FIG. 3*b*. On each accelerator module (FIG. 3*b*) jet-water flow 30 from water source 22 is injected by nozzle 24 through adjustable aperture 28 onto the ride surface, preferably between the rider and the ride surface. Flow control valve 23 and adjustable aperture 28 permit adjustment to water flow velocity, thickness, width, and pressure. The thickness and velocity of the sheet water flow is preferably adjusted such that is creates simultaneously a drag or pulling effect upon the ride participant and/or ride vehicle and also a hydroplaning or sliding effect between the ride surface and the ride participant and/or vehicle. The hydroplaning effect eliminates or reduces friction between the rider/vehicle and the ride surface, while the drag or pulling effect tends to pull the rider/vehicle along the ride surface 25.

In the case of the accelerator module 21 the velocity of jet-water flow 30 is moving at a rate greater than the speed of the entering rider 29 and, thus, a transfer of momentum from the higher speed water to the lower speed rider causes the rider to accelerate and approach the speed of the more rapidly moving water. During this process of transferred momentum, a small transient surge 33 will build behind the rider. Transient surge 33 can be minimized by allowing excess build-up to flow over and off the sides of the ride surface 25. Alternatively, other vent mechanisms, e.g., side drains or porous vents, could also be used as desired.

Upward accelerator 42 can comprise a single accelerator module 21 (FIG. 3*b*) or multiple modules 21*a*, 21*b*, 21*c*, et seq. (FIG. 3*a*), as desired. In the multiple module embodiment illustrated in FIG. 3*a*, a rider 29 can move from module 21*a* to module 21*b* to module 21*c*, et seq. with corresponding increases in acceleration caused by the progressive increase in water velocity issued from each subsequent nozzle 24*a*, 24*b*, 24*c*, et seq., until a desired maximum velocity is reached. The water pressure at each nozzle aperture 24*a*, 24*b*, 24*c* can be adjusted to provide such desired operational characteristics.

In a typical injected sheet flow water ride nozzle pressure can range from approximately 5 psi to 250 psi depending upon: (1) size and configuration of nozzle opening; (2) the weight and friction of a rider relative to the riding surface; (3) the consistency of riding surface friction; (4) the speed at which the rider enters the flow; (5) the physical orientation of the rider relative to the flow; (6) the angle of incline or decline of the riding surface; and (7) the desired increase or decrease in speed of the rider due to flow-to-rider kinetic energy transfer. In an injected sheet flow water ride attraction that utilizes vehicles, nozzle pressure range can be higher, given that vehicles can be designed to withstand higher pressures than the human body and can be configured for greater efficiency in kinetic energy transfer. The flow control valve 23 of the accelerator module 21 (FIG. 3*b*) can be used to adjust nozzle pressure and flow as operational parameters dictate and can be remotely controlled and programmed.

The driving mechanism or energy source which provides the required water flow and pressure at the water source 22 of each propulsion module 21 is a plurality of pumps contained, for example, within a suitable pump house or building 92 (FIG. 1). Such pumps are in fluid communication with each of the accelerator modules 40*a*, 40*b*, 42, 44 via pressurized supply lines 102, 106, 100, 104, respectively. The pumps are also in fluid communication with the start basin 72 and an optional surge tank 94. The surge tank 94 provides a low point reservoir to collect and facilitate re-pumping of vented water and also provides a holding and/or filtration tank for recycled water.

In conventional water ride architecture, a single large pump may be used to provide water to a plurality of accelerator modules and/or other water injection units using a suitable distribution manifold. It is also known to use separate smaller pumps for each accelerator module or a series of modules connected together. The particular configuration and number of pumps chosen for a given system is typically dictated by factors such as the cost and pumping capacity of each pump, the size and nature of the particular ride and the type of ride effect desired. In normal operation the particular pump configuration chosen does not affect the performance of the ride.

Occasionally, however, it has been observed that one of the pumps in the water ride pumping system will fail or become sufficiently impaired such that it is no longer able to function at the required capacity and/or head. In such cases, the pump may have to be shut-off for replacement or repair. Similarly, an associated filter or nozzle may become congested or clogged such that the required flow rate is not achieved. In such cases and with water rides configured in a conventional manner the whole water ride is adversely affected and is typically required to be shut down to facilitate service and/or repair of the malfunctioning component.

Consider, for example, the upward accelerator 42 of FIG. 3*a*. If a pump feeding the furthest downstream nozzle 24*c* of the ride becomes impaired or non-operational for whatever reason, the remaining injected water flows from nozzles 24*a*, 24*b* may be inadequate to push the rider 29 up the remaining portion of the incline. In that event the rider 29 will stall on the ride surface. If the ride is not shut down, there may be a risk that other riders may be accelerated up the incline by upward accelerator 42, possible colliding with the stalled rider and causing injury.

But, shutting down the ride is an undesirable and disadvantageous situation because ride patrons may become upset or impatient waiting for the ride to be repaired and restarted. Also, patrons on the ride during a forced shut-down may be effectively stranded on the ride for some duration until such time as it can be successfully repaired and restarted. Excessive down-time can lead to lower overall rider throughput and, therefore, reduced profits for the ride owner/operator. It is analogously obvious that the blockage and clogging of water filters and nozzles and the like in a water ride hydraulic system could also have similar detrimental effects on the safety, quality and profitability of the ride.

Redundant Pump and Filter Array

Figure 4:
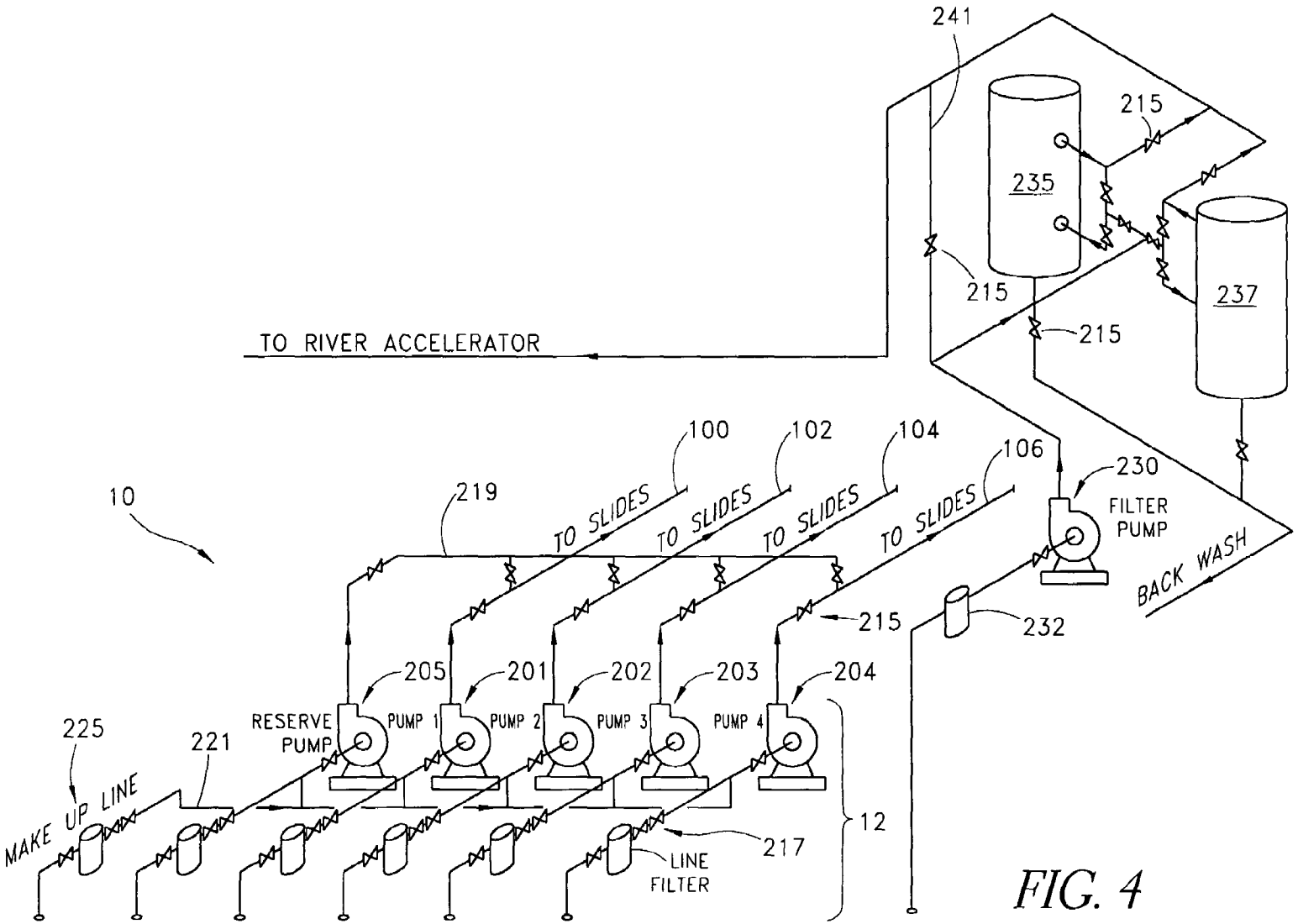
FIG. 4 is a simplified schematic diagram of a redundant array pumping and filtration system having features and advantages in accordance with the present invention.

Advantageously, the present invention overcomes some or all of these limitations by providing a pumping system comprising a redundant pump and filter array for facilitating rapid ride recovery following a pump failure or related component failure. FIG. 4 is a simplified schematic plumbing diagram illustrating one possible embodiment of a pumping system 10 comprising a redundant pump and filter array 12 which exploits the advantages of the present invention.

The pumping system 10 of FIG. 4 is best discussed and understood in the context of the water coaster style ride illustrated in FIG. 1. As illustrated and discussed above, the water ride 90 generally includes a water reservoir or sump 94 and a pumping system contained within a pump house 92. Feedlines 100, 102, 104 and 106 originate from the pump house 92 and are connected to respective nozzles N2, N5, N7 and N10 of accelerator modules 42, 40*a*, 44, 40*b*, respectively.

With the water ride 90 of FIG. 1 in operation, a rider 29 (with or without a vehicle) enters a start basin 72 and commences a descent in the conventional manner along downhill section 74. Upon entering an uphill section 76 the rider 29 encounters an upward nozzle N2 which injects a high-speed flow that accelerates and enhances the elevation of the rider 29 to the top of the uphill section 76. Thereafter, the rider 29 continues onto the bottom of a downhill section 78 where the rider 29 encounters a horizontal nozzle N5 which injects a high-speed flow that accelerates and enhances the elevation of the rider 29 to the top of an uphill section 80. Further, moving down a downhill section 82 the rider 29 encounters a downward nozzle N7 which injects a high-speed flow that accelerates the rider 29 downhill eventually imparting enough momentum to enable the rider 29 to ascend over the top of an uphill section 84. The rider then encounters a horizontal nozzle N10 which injects a high-speed flow that accelerates the rider eventually imparting enough momentum to enable the rider 29 to ascend over the top of the uphill section 86, wherein the ride of the rider 29 terminates in an end basin or splash pool 73.

Preferably, the pumping system 10 (FIG. 4) provides a sufficient quantity of high pressure water to each of the nozzles N2, N5, N7 and N10 to enable the rider 29 to complete the afore-described path. In this regard, those skilled in the art will recognize that the nozzles N2, N5, N7 and N10 may either be operated simultaneously and continuously, such as for continuous rider throughput; or successively and intermittently (i.e. only as needed), such as for individual or spaced riders. In either case, the velocity of water that issues from each respective nozzle N2, N5, N7 and N10 is dictated by factors such the size and shape of the nozzle, hydraulic pressure at the nozzle inlet, friction (or flow blockages) within the hydraulic system, and the free flow path at the nozzle outlet.

Hydraulic pressure at each nozzle inlet is preferably maintained by a pumping system 10 (FIG. 4). Generally, the pumping system 10 comprises a pump and filter array 12 arranged in an N+1 redundant array—in this case four primary pump/filter combinations 201–204 and one reserve pump/filter combination 205. Each primary pump/filter combination in the array 12 is adapted to supply water under pressure to a corresponding accelerator module 42, 40*a*, 40*b*, 44 (FIG. 1) via supply lines 100, 102, 104, 106. At least one reserve pump/filter combination 205 is provided and hydraulically coupled to the system such that any one of the primary pump/filter combinations 201–204 can be hydraulically disconnected or bypassed from the system and effectively replaced with the reserve pump/filter combination 205. In this manner, if one pump/filter combination should suffer a failure or impairment it can be bypassed from the system and replaced hydraulically with the reserve pump.

Preferably the various pumps and filters comprising the pumping system 10 are hydraulically arranged and coupled through suitable valves 215, check valves 217, bypass manifolds 219, 221 and the like such that the various pump/filter combinations can be "hot swapped" with one or more reserve pump/filter combinations. In this manner, a failed pump or other component may be easily and transparently removed or disconnected from the pumping system while the system is operating without affecting the remaining pumps or ride performance. Most preferably, this "hot swapping" is effected automatically by a suitable control and diagnostics system, described in more detail later.

If desired, an additional line filter 225 ("make up line") may be provided as part of the pumping system 10 so as to provide, in effect, an N+1+1 redundancy of line filters. Assume, for example, that one of the primary pump/filter combinations fails and the reserve pump/filter combination 205 is switched into the circuit to make up for the lost pumping capacity. But, before the failed primary pump/filter combination can be repaired or replaced, one of the associated line filters becomes clogged. In this event, the N+1+1 filter redundancy would enable the clogged filter to be hydraulically disconnected from the fluid circuit to facilitate cleaning or repair while the make up line and filter 225 provide a hydraulic "stand-in" for the clogged filter. Again, suitable valves 215, check valves 217, bypass manifolds 219, 221 and the like are preferably provided such that the clogged filter can be "hot swapped" (preferably automatically) with the make up line and filter 225. Alternatively, those skilled in the art will recognize that the various line filters may themselves be arranged in an N+1 or N+2 redundant array and connected together using one or more suitable valves 215, check valves 217, manifolds 219, 221 and the like.

In the particular pumping system 10 illustrated in FIG. 4, an optional filter pump 230 and associated line filter 232 is advantageously provided so as to facilitate parallel or "off-line" filtering of recirculated water via filter tanks 235, 237. These are typically sand filters or replaceable cartridge filters and, if desired, may be arranged in an N+1 redundant array, as shown. Again, suitable valves 215, check valves 217, bypass manifolds 219, 221 and the like are preferably provided such that one filter 235 can be "hot swapped" (preferably automatically) with the other filter 237 (or vice versa) so as to ensure continuous ride operation. If desired, a portion of the water flow from filter pump 230 may be selectively diverted via a bypass line 241 to drive an associated water ride, such as a lazy river or the like, if desired.

Figures 5, 6:
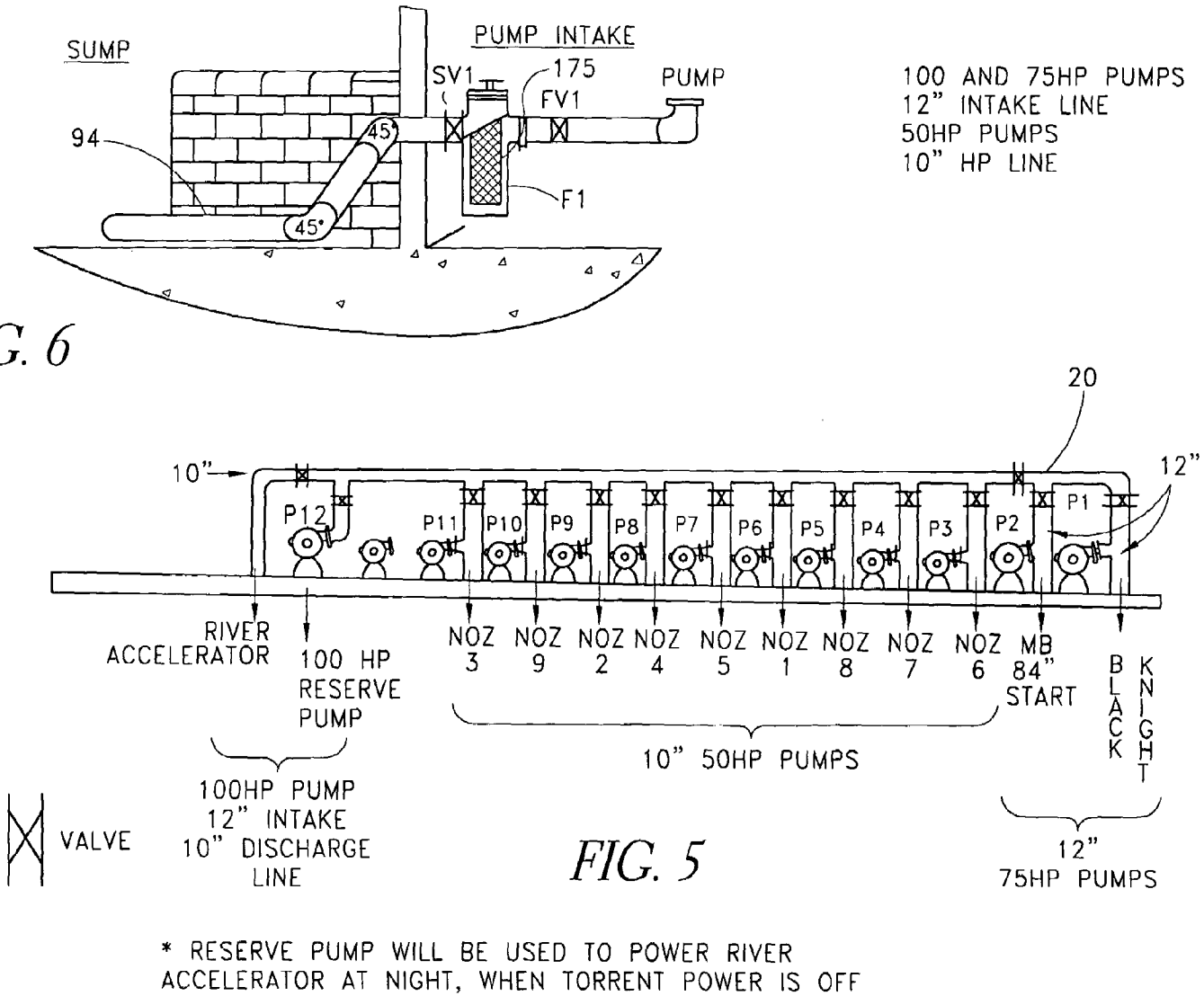
FIG. 5 is a front elevation view of a redundant pump and filter array system having features and advantages in accordance with the present invention.
FIG. 6 is a partial schematic cross-section view of a line filter for use in accordance with the redundant pump and filter array system of FIG. 5.

FIGS. 5–7 are schematic illustrations of an alternative embodiment of a pumping system 10 having features and advantages of the present invention. In this case, the pumping system 10 includes both a redundant pump array 16 and a redundant filter array 18 feeding an array of nozzles 13. The nozzles N1-11 each preferably include an associated flow control valve FCV1, FCV2, FCV3, FCV4, FCV5, FCV6, FCV7, FCV8, FCV9, FCV10 and FCV11, as shown in FIG. 7*a*, to provide localized adjustment and control of the injected flow to achieve a desired ride effect.

Preferably, the redundant pump array 16 includes a plurality of primary pumps P1, P2, P3, P4, P5, P6, P7, P8, P9, P10 and P11, and at least one auxiliary or reserve pump P12. Preferably, the redundant filter array 18 includes a plurality of primary filters F1, F2, F3, F4, F5, F6, F7, F8, F9, F10 and F11, and at least one auxiliary or reserve filter F12. Preferably, the nozzle system 13 includes a plurality of nozzles N1, N2, N3, N4, N5, N6, N7, N8, N9, N10 and N11.

The redundant pump array 16, the redundant filter array 18, and the plurality of nozzles 13 are hydraulically coupled to one another, as illustrated in FIG. 5, by a variety of standard plumbing fittings such as pipes, tees, elbows, collars, flanges, bushings, bells, valves and the like (not shown). The sump 94 (FIG. 6) is the water source for providing water for an injected sheet flow water ride (e.g. FIG. 1) or other water ride having multiple water injection nozzles. The plumbing leading out of the sump 94 includes valves SV1, SV2, SV3, SV4, SV5, SV6, SV7, SV8, SV9, SV10, SV11 and SV12 which connect the sump to filters F1 to F12, respectively (see, e.g. FIG. 6).

The valves SV1 to SV12 are preferably open-close type valves, such as butterfly valves, and are preferably electro-mechanically or hydro-mechanically operated such as via a solenoid, piston or other convenient actuator responsive to an actuation signal from an associated controller. Alternatively, other suitable valves and actuators may also be used with efficacy, including gate valves, plug valves and ball valves among others. Those skilled in the art will readily recognize that throttle valves may also be used, as desired, to provide flow control.

Preferably, and as shown more particularly in FIGS. 5 and 6, the redundant pump array 16 includes a pump bypass manifold 20. Preferably, the pump bypass manifold 20 and the piping leading to the nozzles N1 to N11 has a nominal diameter of about 25–30 cm (10–12 inches). The bypass manifold 20 permits the output from the auxiliary pump P12 to be fed to one of the nozzles N1 to N11 positioned along the water ride 90 as will be discussed in more detail later herein. The pump array 16 preferably also includes a plurality of valves PV1, PV2, PV3, PV4, PV5, PV6, PV7, PV8, PV9, PV10 and PV11 positioned downstream of the discharge end of respective pumps P1 to P11. The settings of the valves PV1 to PV11 are used to manage the output from the respective pumps P1 to P11 to the respective nozzles N1 to N11. Preferably, the pump array 16 further includes a plurality of valves PMV1, PMV2, PMV3, PMV4, PMV5, PMV6, PMV7, PMV8, PMV9, PMV10 and PMV11 disposed in communication with the pump manifold 20, and valves APV12 and APV13 associated with the auxiliary pump P12. The settings of the valves PMV1 to PMV11 and the valves APV12 and APV13 in conjunction with the settings of the valves PV1 to PV11 are responsible for directing the water output from the pumps P1 to P11, and P12 as needed or desired, along predetermined paths to predetermined destinations as will be discussed at greater length later herein. Again, these various valves are preferably open-close type valves, such as butterfly valves, and are preferably electro-mechanically or hydro-mechanically operated such as via a solenoid, piston or other convenient actuator responsive to an actuation signal from an associated controller. Alternatively, other suitable valves and actuators may also be used with efficacy, including gate valves, plug valves and ball valves among others. Those skilled in the art will readily recognize that any one of a number of throttle valves may also be used, as desired, to provide flow control.

Figure 7A:
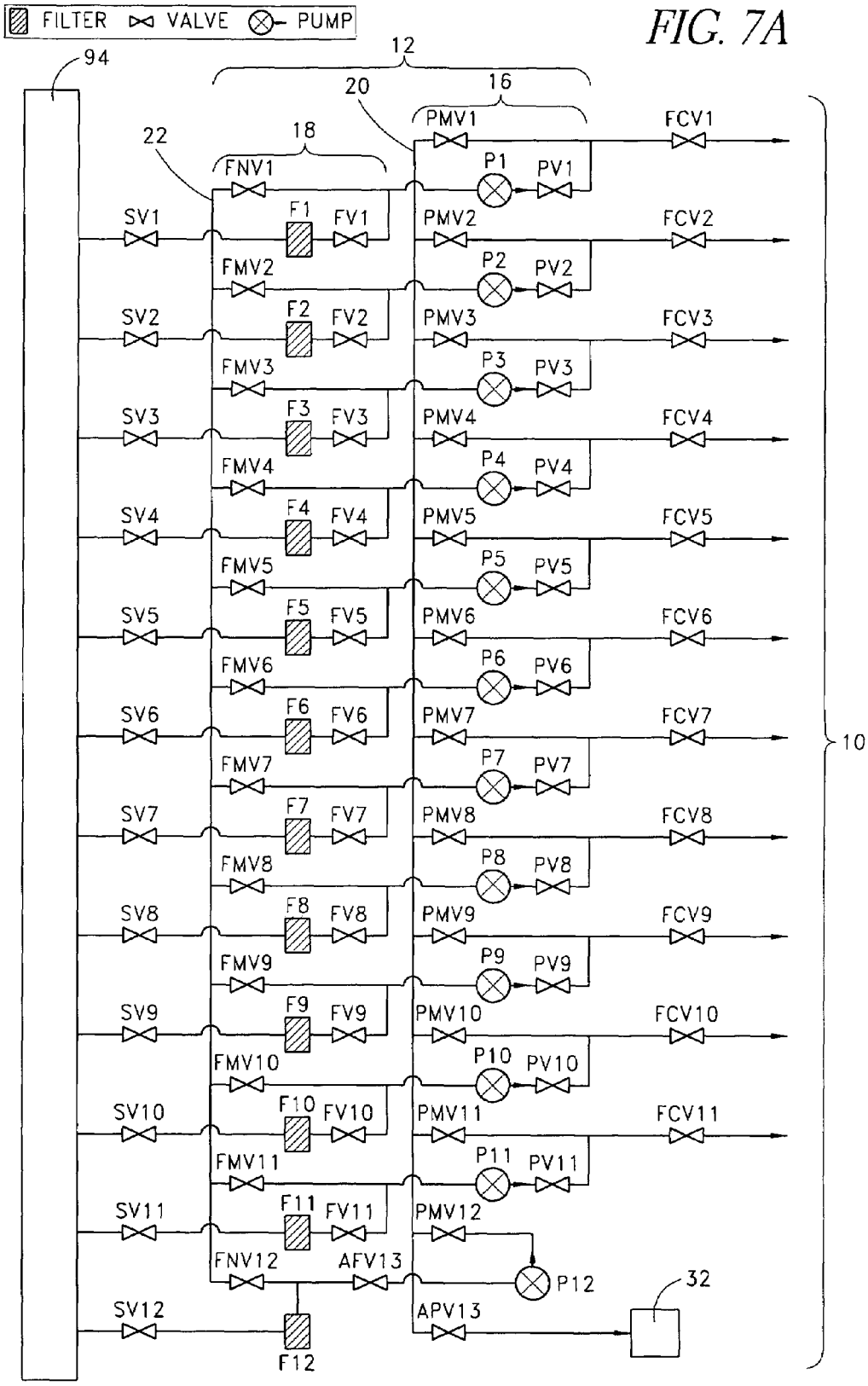
FIGS. 7*a–d* are schematic fluid circuit diagrams of the redundant pump and filter array system of FIG. 5, illustrating various modes of preferred operation thereof.

In the preferred embodiment illustrated in FIG. 7*a* the redundant pump array 16 includes eleven primary pumps P1 to P11 and one auxiliary pump P12. Of course, the number of primary pumps may be increased or decreased, as desired or needed, and is partly dependent on the nature of the ride. Similarly, more than one auxiliary pump may be incorporated into the hydraulic system described herein if additional backup capacity is required or desired. Moreover, a grouping of pumps may be substituted for a particular pump by connecting a plurality of pumps in series, parallel or a combination thereof. It will be readily apparent to those of ordinary skill in the art that the redundant pumping system of the present invention can include N+x pumps, where N is the number of primary pumps, x is the number of auxiliary pumps, and N and x are both integers greater than or equal to one, with x preferably being equal to one.

Preferably, the pumps P1 to P12 of the redundant pump array 16 shown in FIG. 5 are centrifugal pumps, having a pressure head from about 23–37 m (75 to 120 feet) of water and a capacity of about 60–110 L/s (1000 to 1800 GPM), though various other types of pumps may be used such as rotary action pumps (employing vanes, screws, lobes, or progressive cavities), jet pumps and ejector pumps among others. Preferably, the maximum pumping power available from each one of the pumps P1 to P12 is about 37–74 kw (50 to 100 horsepower). The pumps P1 to P12 can preferably provide water at a pressure of about 0.35–17.2 Bar (5 psi to 250 psi) to the nozzles N1 to N11. In a most preferred embodiment, the pumps P1 to P12 are ITT Marlow pumps manufactured by Flygt of Trumbull, Conn.

Similarly, and as shown in FIG. 7*a*, the redundant filter system 18 includes a filter bypass manifold 22. Preferably, the filter bypass manifold 22, its associated piping and the piping leading to the pumps P1 to P12 has a nominal diameter of about 15–30 cm (6–12 inches). The filter bypass manifold 22 permits the auxiliary filter F12 to serve as a substitute for one of the primary filters F1 to F11 as will be discussed in more detail later herein. The filter system 18, preferably, also includes a plurality of valves FV1, FV2, FV3, FV4, FV5, FV6, FV7, FV8, FV9, FV10 and FV11 positioned downstream of the outlet of respective filters F1 to F11. The settings of the valves FV1 to FV11 are used to manage the water flow through the respective filters F1 to F11 to the respective pumps P1 to P11. Preferably, the filter system 18 further includes a plurality of valves FMV1, FMV2, FMV3, FMV4, FMV5, FMV6, FMV7, FMV8, FMV9, FMV10 and FMV11 disposed in the filter manifold 22, and valves AFV12 and AFV13 associated with the auxiliary filter F12.

The settings of the valves FMV1 to FMV11 and the valves AFV12 and AFV13 in conjunction with the settings of the valves FV1 to FV11 are responsible for directing the water flow through the filters F1 to F11, and F12 as needed or desired, along predetermined paths to the pumps P1 to P11, and P12 as needed or desired, as will be discussed at greater length later herein. Again, these various valves are preferably open-close type valves, such as butterfly valves, and are preferably electro-mechanically or hydro-mechanically operated such as via a solenoid, piston or other convenient actuator responsive to an actuation signal from an associated controller. Alternatively, other suitable valves and actuators may also be used with efficacy, including gate valves, plug valves and ball valves among others. Those skilled in the art will readily recognize that any one of a number of throttle valves may also be used, as desired, to provide flow control.

In the preferred embodiment illustrated in FIG. 7*a* the redundant filter system 18 includes eleven primary filters F1 to F11 and one auxiliary filter F12. These can be any of a wide variety of commercially available strainer baskets or line filters as are well known in the art. The filter element of each of the filters F1 to F12 may be a replaceable strainer basket or filter cartridge 175, such as illustrated in FIG. 6. In a most preferred embodiment, the filters F1 to F12 are strainer baskets manufactured by ETA USA, a subsidiary of NBGS International of New Braunfels, Tex. The inlet and outlet openings of the filters F1 to F12 preferably have a nominal diameter of about 15–30 cm (6 inches to 12 inches). The pressure drop through each line filter F1 to F12 is preferably relatively small (less than 5% total head) at full rated capacity.

Of course, the number of primary filters may be increased or decreased, as desired or needed. Similarly, more than one auxiliary filter may be incorporated into the hydraulic system described herein, and more than one filter may be associated with a particular pump by connecting a plurality of filters in series, parallel or a combination thereof, as desired. Preferably, the redundant filter system of the present invention includes N+x filters, where N is the number of primary pumps, x is the number of auxiliary pumps, and N and x are both integers greater than or equal to one, with x preferably being equal to one.

In normal operation of the water pumping system 10 the pumps P1 to P11 are operated and draw water through respective line filters F1 to F11. Pumps P1 to P11 increase the head of the water and thereby provide the requisite pressurized water flow to the respective nozzles N1 to N11. Thus, the water flow to nozzle N1 begins from the sump 94, and flows through valve SV1, filter F1, valve FV1, pump P1, valve PV1 and ultimately to nozzle N1. Water to nozzles N2 to N11 follows a similar respective path. In normal operation, the auxiliary pump P12 and the auxiliary filter F12 are generally not active.

Figure 7B:
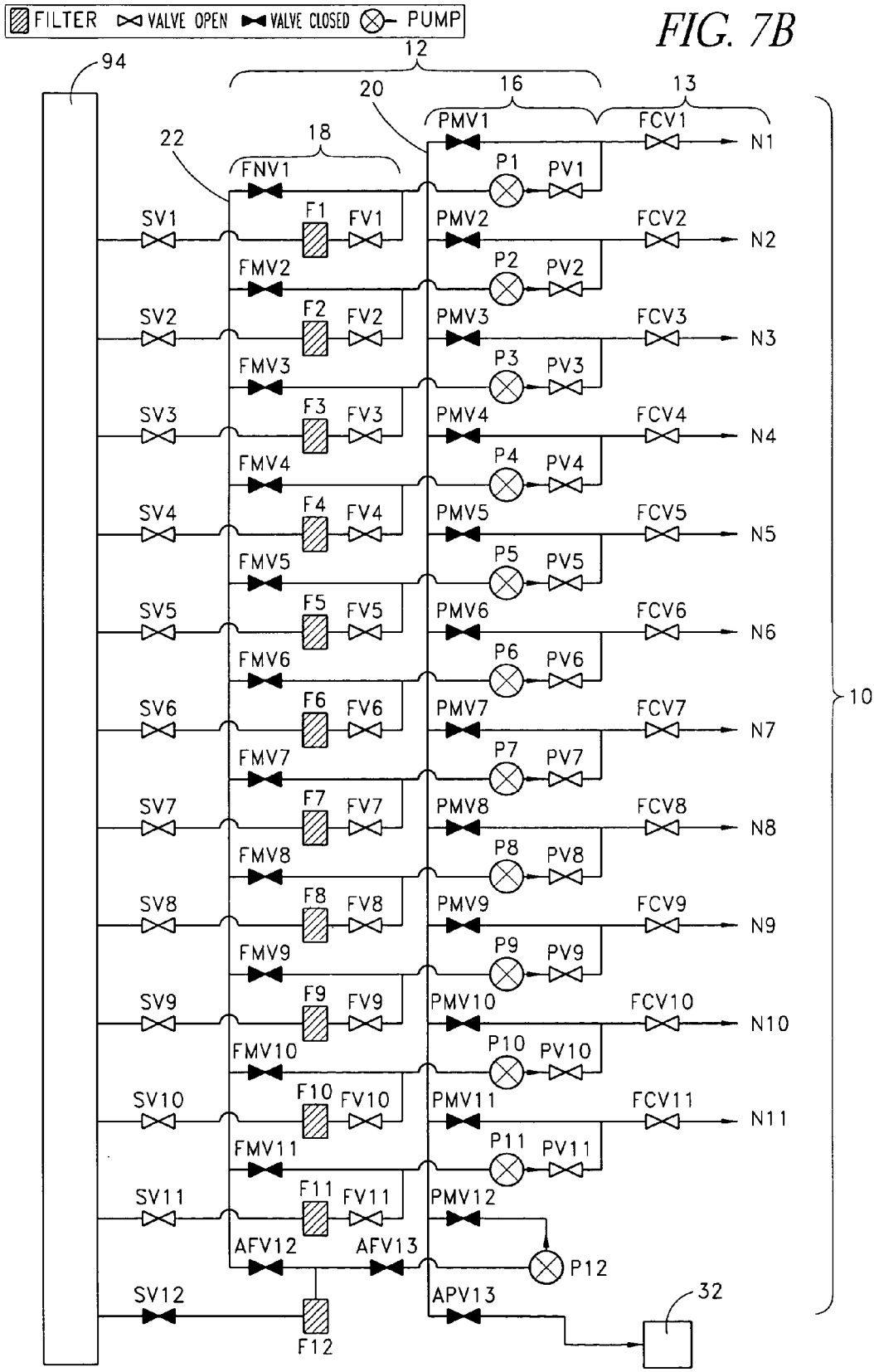

FIG. 7*b* depicts the settings of the various valves in the pumping system 10 during normal operation. An open (conducting) valve is shown as "white" or "⋈" and a closed (blocked) valve is shown as "black" or "⧓" During normal operation sump valves SV1 to SV11 are open, filter manifold valves FMV1 to FMV 11 are closed, filter valves FV1 to FV11 are open, pump manifold valves PMV1 to PMV11 are closed, pump valves PV1 to PV11 are open. This enables primary pumps P1 to P11 to draw water, through respective primary filters F1 to F11, from the sump 94 and provide it to respective nozzles N1 to N11. Also, valves SV12, AFV12, AFV13, APV12 and APV13, which are associated with the auxiliary pump P12 and the auxiliary filter F12, can either be open or closed though it is preferred that they are closed, as illustrated in FIG. 7*b*, to totally isolate the redundant auxiliary pump P12 and auxiliary filter F12 during normal operation of the hydraulic system 10. As discussed above, the auxiliary pump P12 and the associated auxiliary filter F12 provide redundancy to the pumping system 10 and ensure smooth operation of an associated water ride in the event that one of the pumps P1 to P11 has to be shut-off for maintenance or replacement or if one of the primary filters F1 to F11 has to be cleaned or replaced.

Figure 7C:
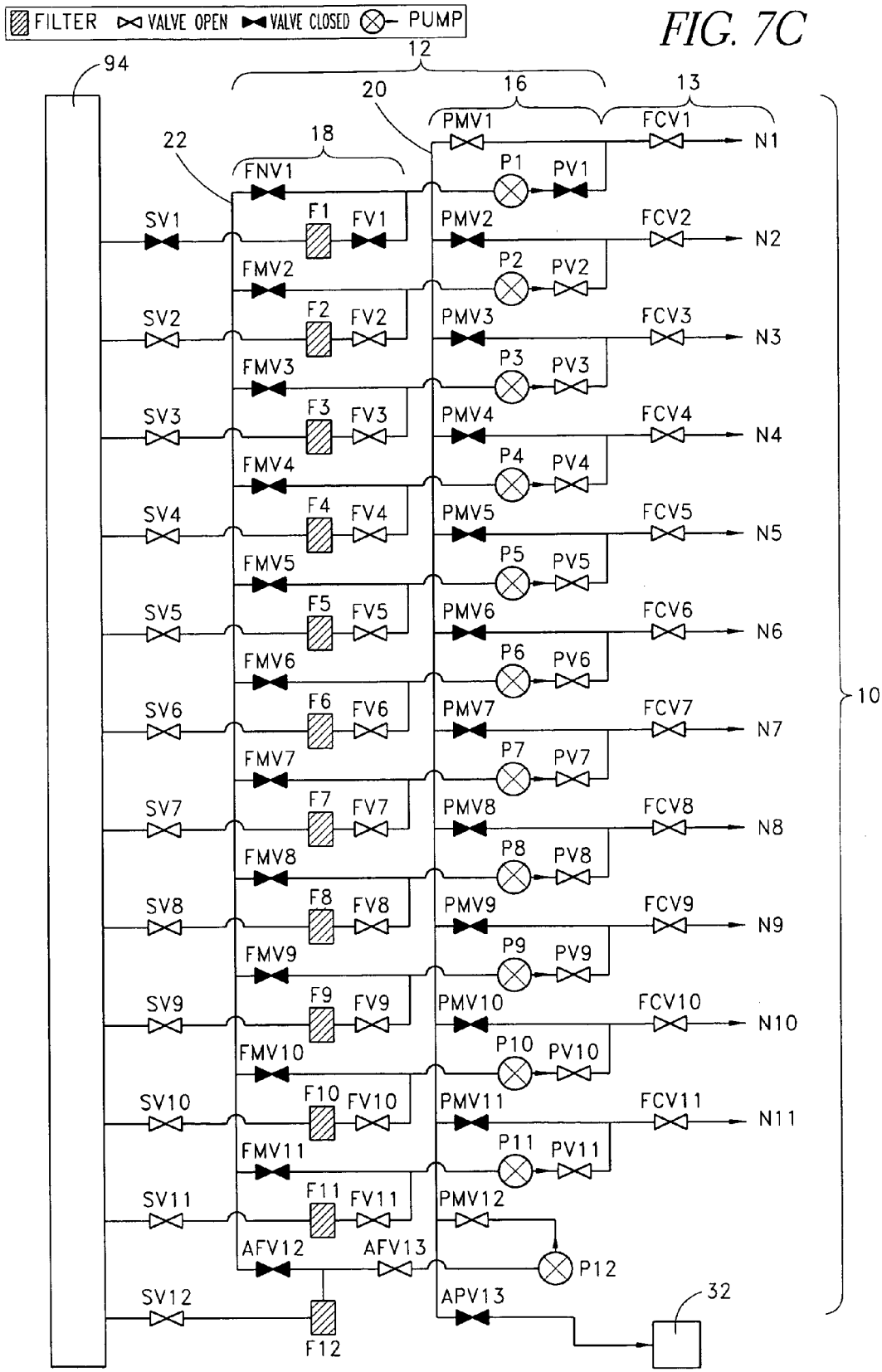

FIG. 7*c* illustrates the situation where primary pump P1, for example, has to be shut-off. In that case, auxiliary pump P12 is switched in to make up for the lost capacity and to ensure that the pumping system 10 provides the requisite water supply to nozzle N1. Procedurally, this is accomplished by turning off primary pump P1, turning on auxiliary pump P12, closing valve PV1, and opening valves PMV1, SV12, AFV13 and APV12, so that the water flow to nozzle N1 is substantially not disrupted or is only briefly interrupted. Preferably this is all done automatically, as will be discussed in more detail below, although manual operation of the system in this manner is also effective. In this P1 bypass configuration auxiliary pump P12 draws water from the sump 94 through valve SV12, auxiliary filter F12, valve AFV13, and provides it to the nozzle N1 through valve APV12, the pump manifold 20 and valve PMV1. Valves SV1 and FV1 may remain open or be closed, but it is preferred that they be closed, as shown in FIG. 7*c*, to totally isolate the primary pump P1 and associated primary filter F1. The looping out of primary pump P1 and the re-routing of water flow from auxiliary pump P12 to nozzle N1 is preferably accomplished while the remaining pumps and the ride remains in operation, thus providing "hot swapping" of the affected components.

When primary pump P1 is ready to be turned on again (after inspection, servicing, repair or replacement) the above-described procedure is simply reversed and auxiliary pump P12 is looped out of the redundant pumping system 16 and the water is again routed from primary pump P1 to the nozzle N1, to restore normal operation of the hydraulic system 10, all without shutting down the ride. Procedurally, this is accomplished by turning off auxiliary pump P12, turning on primary pump P1, closing valve PMV1, and opening valves SV1, FV1 and PV1, so that the water flow to the ride 90 (FIG. 1) is not disrupted or interrupted. Again, valves SV12, AFV13 and APV12 may remain open or be closed during normal operation of the hydraulic system 10, though it is preferred that they be closed as illustrated in FIG. 7*c*.

The above-described looping out of the primary pump P1 utilizes the auxiliary pump P12 in conjunction with the auxiliary filter F12. Those of ordinary skill in the art will readily recognize that by minor modification of the hydraulic system 10 the auxiliary pump P12 can be used in conjunction with a primary filter. For example, if primary pump P1 needs to be shut-off but primary filter F1 is operational, the auxiliary pump P12 may be used with the primary filter F1. This can be realized, for example, by having a pipe, disposed with a valve, connecting the outlet of the filter F1 to the suction end of primary pump P12. Then by adjustment of the appropriate valves the primary filter F1 and the auxiliary pump P12 can be coupled to provide water flow to nozzle N1. Similarly, primary filters F2 to F11 may be connected to the auxiliary pump P12. Since such a modification to the hydraulic system 10 would be obvious to those skilled in the art it will not be discussed in detail herein and is not shown in the drawings, but this modification lies within the scope of the present invention.

Figure 7D:
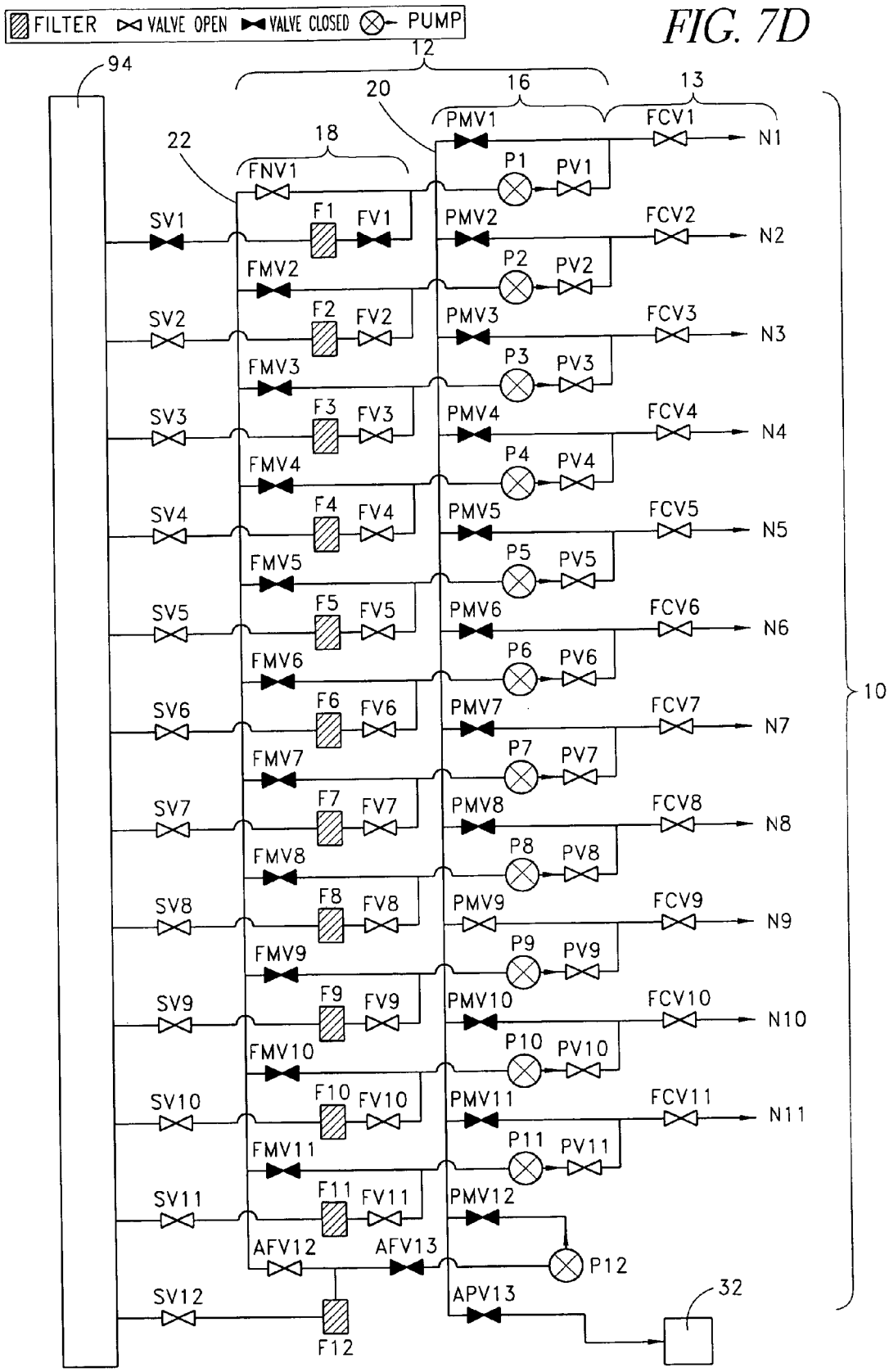

FIG. 7*d* illustrates the situation where primary filter F1, for example, becomes clogged and has to be cleaned or replaced. In that case, a similar "hot swapping" methodology can again be used to safely perform the inspection, servicing or replacement of the primary filter, while re-routing the water flow through the auxiliary filter F12, without interruption or disruption of the water pumping system or associated water ride. For example, if primary filter F1 has to be looped out, auxiliary filter F12 takes over the responsibility of filtering the water being drawn by primary pump P1, as illustrated by the valve settings of FIG. 7*d* (open valves are shown as "white" or "⋈" and closed valves are shown as "black" or "⧓"). This is accomplished by opening valves SV12, AFV12 and FMV1, and closing valve FV1, so that the water flow to nozzle is not disrupted or is only briefly interrupted. In this manner primary pump P1 draws water from the sump 94 through valve SV12, auxiliary filter F12, valve AFV12, the filter manifold 22, valve FMV1 and provides it to the nozzle N1 through valve PV1. Valve SV1 may remain open or be closed, but it is preferred that it be closed, as shown in FIG. 7*d*, to totally isolate the primary filter F1.

When primary filter F1 is ready to be used again (after inspection, servicing or replacement) the above-described procedure is reversed and auxiliary filter F12 is looped out of the redundant filter system 18 and the water is again routed through primary filter F1 to primary pump P1, to restore normal operation of the hydraulic system 10, all without shutting down the ride. This is accomplished by closing valve FMV1, and opening valves SV1 and FV1, so that the water flow to the ride 90 (FIG. 1) is not disrupted or interrupted. Valves SV12 and APV12 may remain open or be closed during normal operation of the hydraulic system 10, though it is preferred that they be closed as illustrated in 7*d*.

Those of ordinary skill in the art will readily recognize that by minor modification of the pumping system 10 the auxiliary pump P12 can be used in conjunction with a primary filter. For example, if primary pump P1 needs to be shut-off while retaining the operation of primary filter F1, the auxiliary pump P12 may be used with the primary filter F1. This can be realized, for example, by having a pipe, disposed with a valve, connecting the outlet of the filter F1 to the suction end of primary pump P12. Then by adjustment of the appropriate valves the primary filter F1 and the auxiliary pump P12 can be coupled to provide water flow to nozzle N1. Similarly, primary filters F2 to F11 may be connected to the auxiliary pump P12. Since such a modification to the hydraulic system 10 would be obvious to those skilled in the art it will not be discussed in detail herein and is not shown in the drawings, but this modification lies within the scope of the present invention.

Figure 8A:
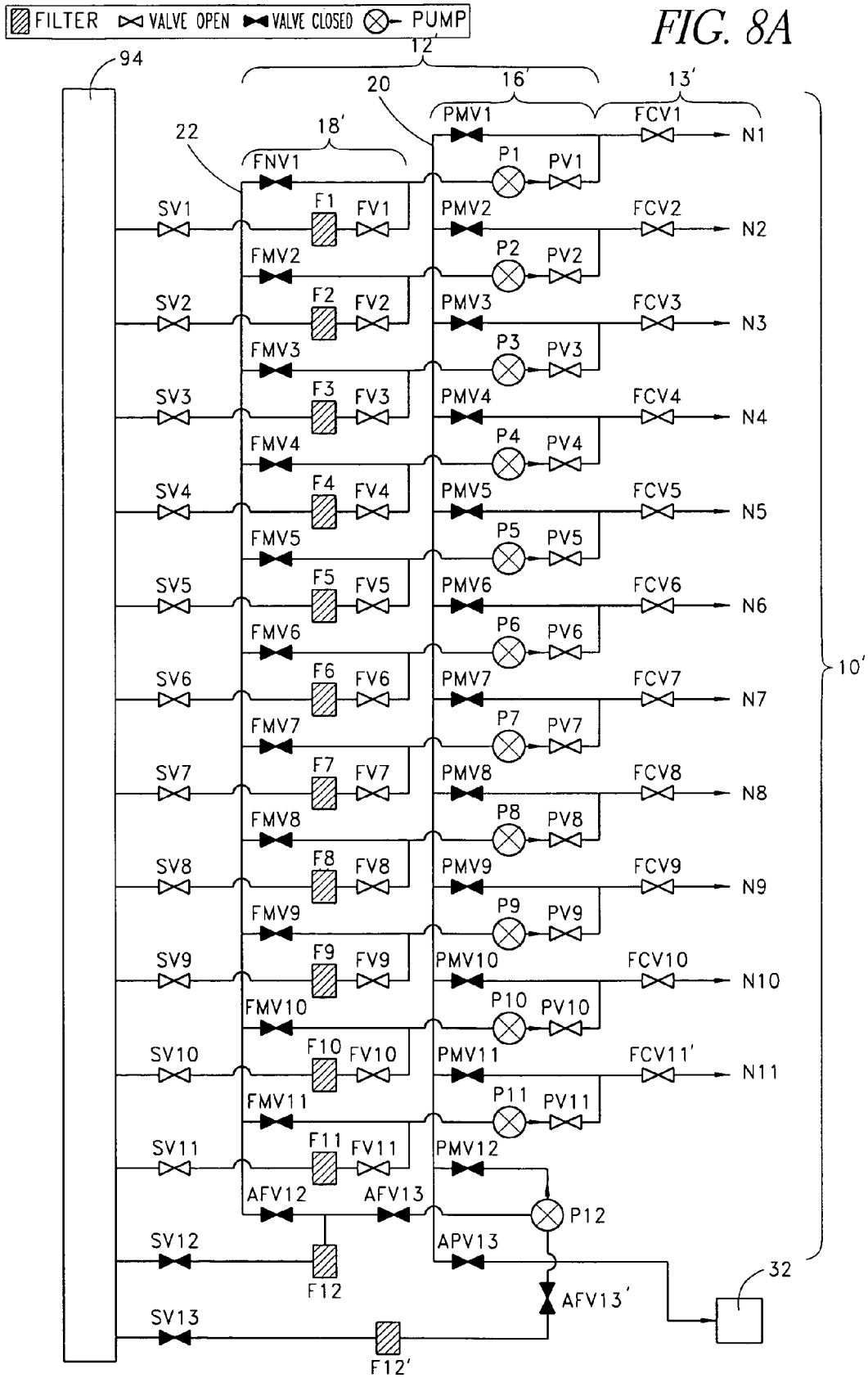
FIGS. 8*a–b* are schematic fluid circuit diagrams of an alternative embodiment of a redundant pump and filter array system having features and advantages in accordance with the present invention, illustrating various modes of preferred operation thereof.

FIGS. 8*a*–8*d* illustrate a further alternative embodiment of a pumping system 10' having features and advantages of the present invention. For ease of illustration and brevity of description like elements are designated using like reference numerals and the descriptions thereof are not repeated herein. The pumping system 10' is similar to that described above, except that it an additional auxiliary filter F12' is provided along with open-close valves SV13 and AFV13', of the type mentioned herein above. FIG. 8*a* depicts the settings of the various valves of the hydraulic pumping system 10' during normal operation. Again, an open (conducting) valve is shown as "white" or "⋈" and a closed (blocked) valve is shown as "black" or "⧓". During normal operation sump valves SV1 to SV11 are open, filter manifold valves FMV1 to FMV11 are closed, filter valves FV1 to FV11 are open, pump manifold valves PMV1 to PMV11 are closed, pump valves PV1 to PV11 are open, thereby allowing primary pumps P1 to P11 to draw water, through respective primary filters F1 to F11, from the sump 94 and provide it to respective nozzles N1 to N11. Also, valves SV12, SV13, AFV12, AFV13, AFV13', APV12 and APV13, which are associated with the auxiliary pump P12 and the auxiliary filters F12 and F12', can either be open or closed though it is preferred that they are closed, as illustrated in FIG. 8*a*, to totally isolate the redundant auxiliary pump P12 and auxiliary filters F12 and F12' during normal operation of the hydraulic pumping system 10'.

Figure 8B:
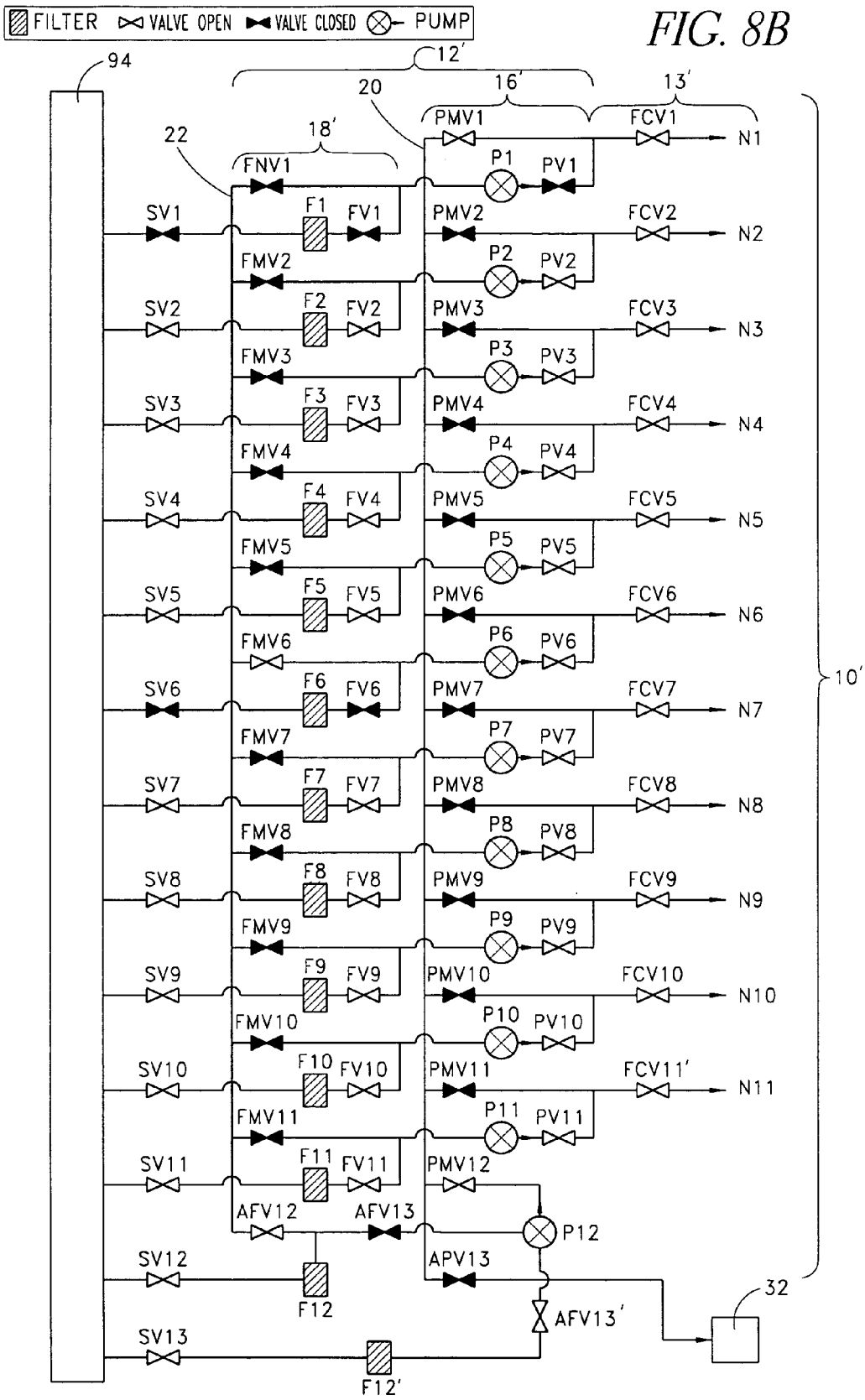

Advantageously, the pumping system 10' depicted in FIG. 8*a* not only allows auxiliary pump P12 to draw water through either one of the auxiliary filters F12 and F12', thereby providing a second level of filter redundancy, but also permits the auxiliary pump P12 and the auxiliary filter F12 to be independently operative. For example, and as illustrated by the valve settings in FIG. 8*b*, auxiliary pump P12 may substitute for primary pump P1 while auxiliary filter F12 is simultaneously substituting for primary filter F6. The looping out of pump P1 is accomplished by turning off primary pump P1, turning on auxiliary pump P12, closing valve PV1, and opening valves PMV1, SV13, AFV13' and APV12, so that the water flow is substantially not disrupted or is only briefly interrupted. In this manner auxiliary pump P12 draws water from the sump 94 through valve SV13, auxiliary filter F12', valve AFV13', and provides it to the nozzle N1 through valve APV12, the pump manifold 20 and valve PMV1. Valves SV1 and FV1 may remain open or be closed, but it is preferred that they be closed, as shown in FIG. 8*b*, to totally isolate the primary pump P1 and associated primary filter F1. Similarly, the isolation of filter F6 is achieved by opening valves SV12, AFV12 and FMV6, and closing valve FV6, so that the water flow again is not substantially disrupted or interrupted. In this manner primary pump P6 draws water from the sump 94 through valve SV12, auxiliary filter F12, valve AFV12, the filter manifold 22, valve FMV6 and provides it to the nozzle N6 through valve PV6. Valve SV6 may remain open or be closed, but it is preferred that it be closed, as shown in FIG. 8*b*, to totally isolate the primary filter F6.

Referring to FIGS. 8*a*, 8*b*, when primary pump P1 is ready to be turned on again (after inspection, servicing, repair or replacement) auxiliary pump P12 is looped out of the redundant pumping system 16' and the water is again routed from primary pump P1 to the nozzle N1, to restore normal operation of the hydraulic system 10', all without shutting down the ride. This is accomplished by turning off auxiliary pump P12, turning on primary pump P1, closing valve PMV1, and opening valves SV1, FV1 and PV1, so that the water flow is not disrupted or interrupted. Again, valves SV13, AFV13' and APV12 may remain open or be closed during normal operation of the hydraulic system 10', though it is preferred that they be closed as illustrated in FIG. 8*a*.

Similarly, when primary filter F6 (see FIGS. 8*a*, 8*b*) is ready to be used again (after inspection, servicing or replacement) the auxiliary filter F12 is looped out of the redundant filter system 18' and the water is again routed through primary filter F6 to primary pump P6, to restore normal operation of the hydraulic system 10', all without shutting down the ride. Referring to FIGS. 8*a*, 8*b*, this is accomplished by closing valve FMV6, and opening valves SV6 and FV6, so that the water flow to the ride 90 (FIG. 1) is not substantially disrupted or is only briefly interrupted. Valves SV12 and APV12 may remain open or be closed during normal operation of the hydraulic system 10', though it is preferred that they be closed as illustrated in FIG. 8*a*.

FIGS. 9*a*–9*d* illustrate a further alternative embodiment of a pumping system 10" having features and advantages of the present invention. For ease of illustration and brevity of description like elements are designated using like reference numerals and the descriptions thereof are not repeated herein. The pumping system 10" is similar to the embodiments described above, except that it is advantageously symmetrically and identically configured such that any one of the pump and filter combinations (either in combination or separately) can be designated as "reserve" or "auxiliary" for purposes of practicing the invention. For example, it may be desirable to rotate reserve designations in the ordinary course of ride operations over several months or years in order to provide for routine maintenance/service of pumps/filters and/or to more evenly distribute wear and tear over the various components.

Figure 9A:
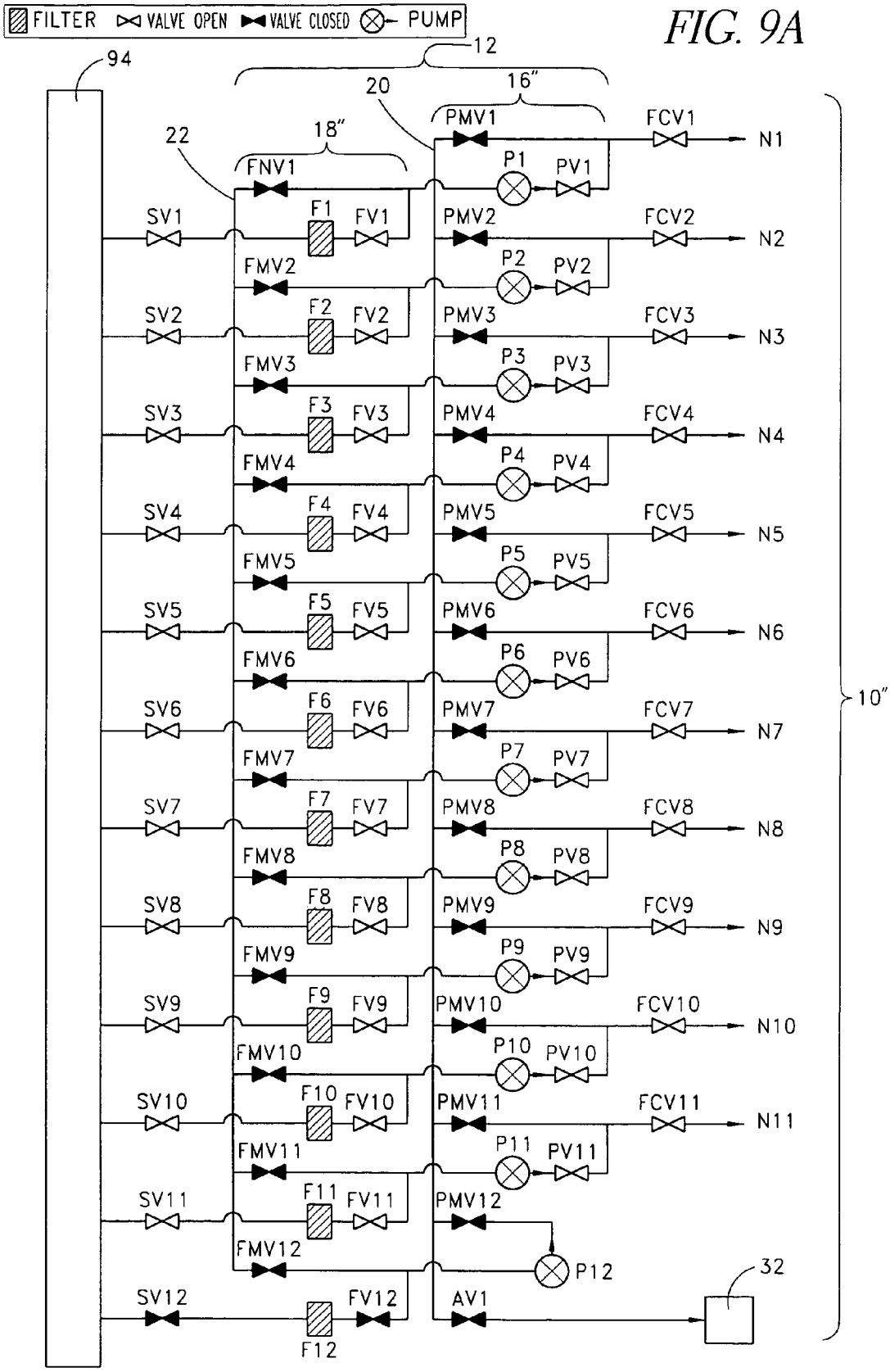
FIGS. 9*a–d* are schematic fluid circuit diagrams of a further alternative embodiment of a redundant pump and filter array system having features and advantages in accordance with the present invention, illustrating various modes of preferred operation thereof.

FIG. 9*a* depicts one such pumping system 10" with the settings of the various valves configured for normal operation. Again, an open (conducting) valve is shown as "white" or "⋈" and a closed (blocked) valve is shown as "black" or "⧓" Assume, for example, that pump P12 and filter F12 are designated as reserve or auxiliary system components. Thus, during normal operation sump valves SV1 to SV11 are open, filter manifold valves FMV1 to FMV 11 are closed, filter valves FV1 to FV11 are open, pump manifold valves PMV1 to PMV11 are closed, pump valves PV1 to PV11 are open. This enables primary pumps P1 to P11 to draw water, through respective primary filters F1 to F11, from the sump 94 and provide it to respective nozzles N1 to N11. Valves SV12, FV12, FMV12 and PMV12, which are associated with the designated auxiliary pump P12 and the designated auxiliary filter F12, can either be open or closed, though it is preferred that they are closed, as illustrated in FIG. 9*a*, to totally isolate the designated redundant auxiliary pump P12 and designated auxiliary filter F12. As discussed above, the designated auxiliary pump P12 and the designated associated auxiliary filter F12 may be selectively designated to provide the desired redundancy to the pumping system 10" and ensure smooth operation of an associated water ride in the event that one of the pumps P1 to P11 has to be shut-off for maintenance or replacement or if one of the primary filters F1 to F11 has to be cleaned or replaced. Alternatively, any one of the other pumps P1–11 or filters F1–11 can be selectively designated as reserve or auxiliary components and pump P12 and filter F12 as primary components, as desired.

Figure 9B:
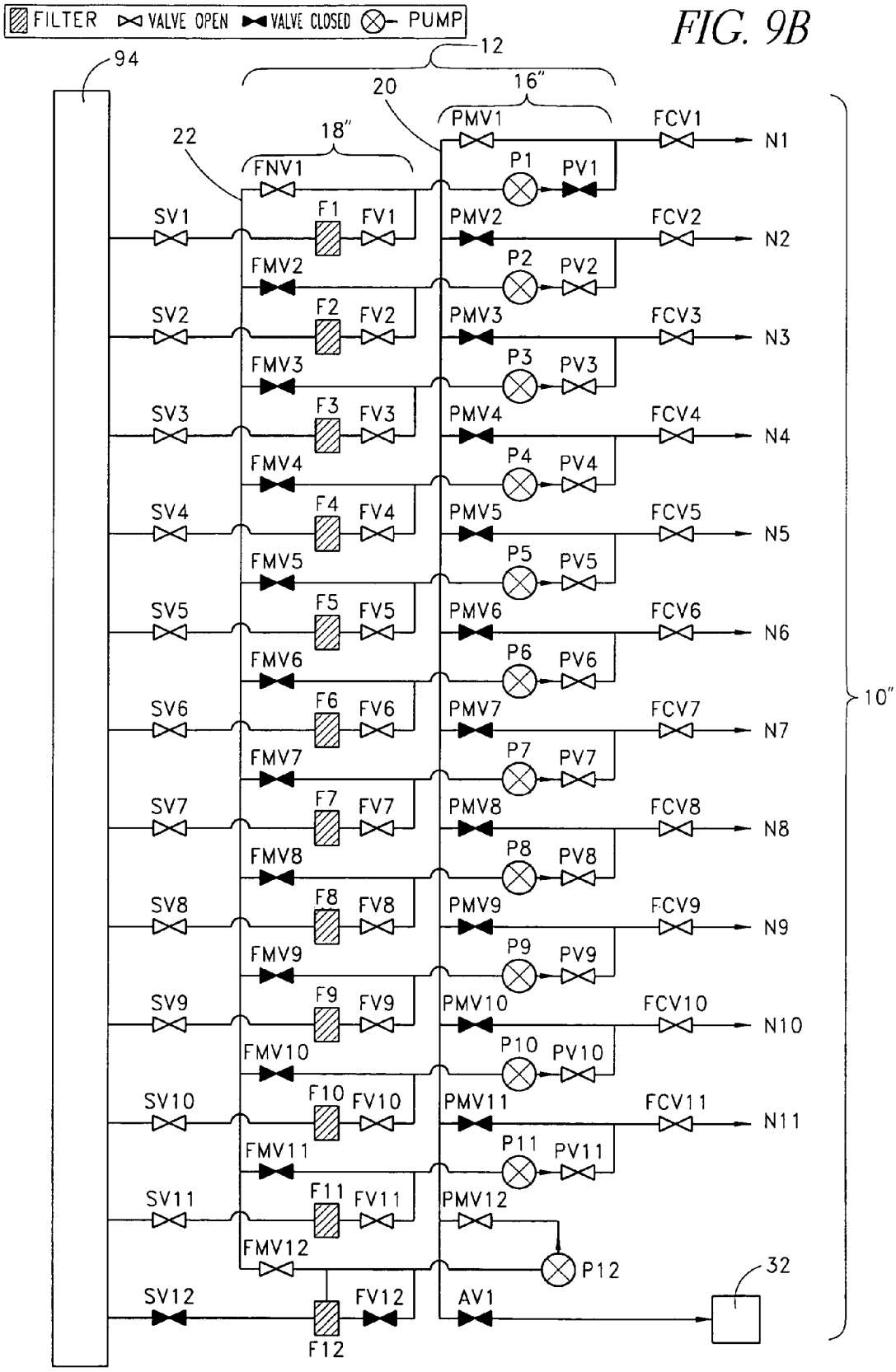

FIG. 9*b* illustrates the situation where primary pump P1, for example, has to be shut-off. In that case, designated auxiliary pump P12 is switched in to make up for the lost capacity and to ensure that the pumping system 10" is able to provide the requisite water supply to nozzle N1. Procedurally, this is accomplished by turning off primary pump P1, turning on designated auxiliary pump P12, closing valve PV1, and opening valves PMV1, FMV12 and PMV12, so that the water flow to nozzle N1 is substantially not disrupted or is only briefly interrupted. Again, this is preferably done automatically although manual operation of the system in this manner is also effective. In this "P1 bypass" configuration auxiliary pump P12 draws water from the sump 94 through valve SV1, through primary filter F1 and valves FV1 and FMV1, through filter bypass manifold 22 and valve FMV12 and provides it to the nozzle N1 under pressure through valves PMV12, pump bypass manifold 20 and valve PMV1. Valves SV12 and FV12 may remain open or be closed, but it is preferred that they be closed, as shown in FIG. 9*b*, to totally isolate the designated auxiliary filter F12. The looping out of primary pump P1 and the re-routing of water flow from auxiliary pump P12 to nozzle N1 is preferably accomplished while the remaining pumps and the ride remains in operation, thus providing advantageous "hot swapping" of the affected components.

When primary pump P1 is ready to be turned on again (after inspection, servicing, repair or replacement) the above-described procedure is simply reversed and designated auxiliary pump P12 is looped out of the pumping system 10" and the water is again routed from primary pump P1 to the nozzle N1, to restore normal operation of the pumping system 10", all without shutting down the ride. Those skilled in the art will note that the above-described looping out of the primary pump P1 continues to utilize associated primary filter F1 so that independent N+1 redundancy is still provided for filter array 18".

Figure 9C:
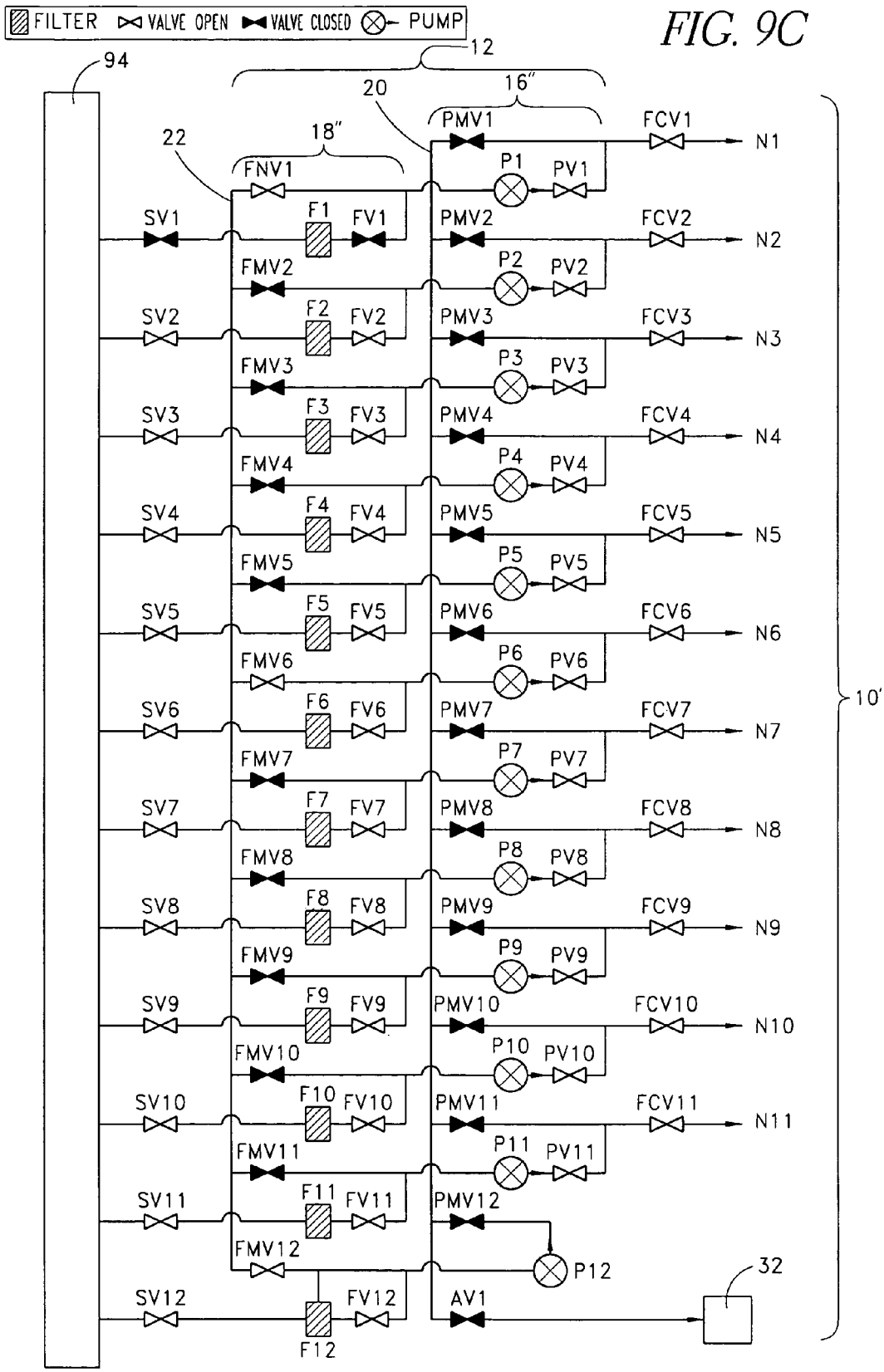

FIG. 9*c* illustrates the situation where primary filter F1, for example, becomes clogged and has to be cleaned or replaced. In that case, designated auxiliary filter F12 is switched in to make up for the lost filter capacity and to ensure that the pumping system 10" is able to provide the requisite water supply to nozzle N1. Procedurally, this is accomplished by closing valve FV1, and opening valves SV12, FMV1, FMV12 and FV12, so that the water flow to nozzle N1 is substantially not disrupted or is only briefly interrupted. Again, this is preferably done automatically although manual operation of the system in this manner is also effective. In this "F1 bypass" configuration primary pump P1 draws water from the sump 94 through valve SV12, through designated auxiliary filter F12 and valves FV12 and FMV12, through filter bypass manifold 22 and valve FMV1 and provides it to the nozzle N1 under pressure through valve PV1. Valve SV1 may remain open or be closed, but it is preferred that it be closed, as shown in FIG. 9*c*, to totally isolate the clogged filter F1. The looping out of primary filter F1 and the re-routing of water flow from designated auxiliary filter F12 to nozzle N1 is preferably accomplished while the remaining pumps and the ride remains in operation, thus providing advantageous "hot swapping" of the affected components.

When primary filter F1 is ready to be turned on again (after inspection, servicing, repair or replacement) the above-described procedure is simply reversed and designated auxiliary filter F12 is looped out of the pumping system 10" and the water is again routed through primary filter F1 to the nozzle N1, to restore normal operation of the pumping system 10", all without shutting down the ride. Those skilled in the art will note that the above-described looping out of the primary filter F1 does not affect the operation of the associated primary pump P1 so that independent N+1 redundancy is still provided for the pump array 16".

Figure 9D:
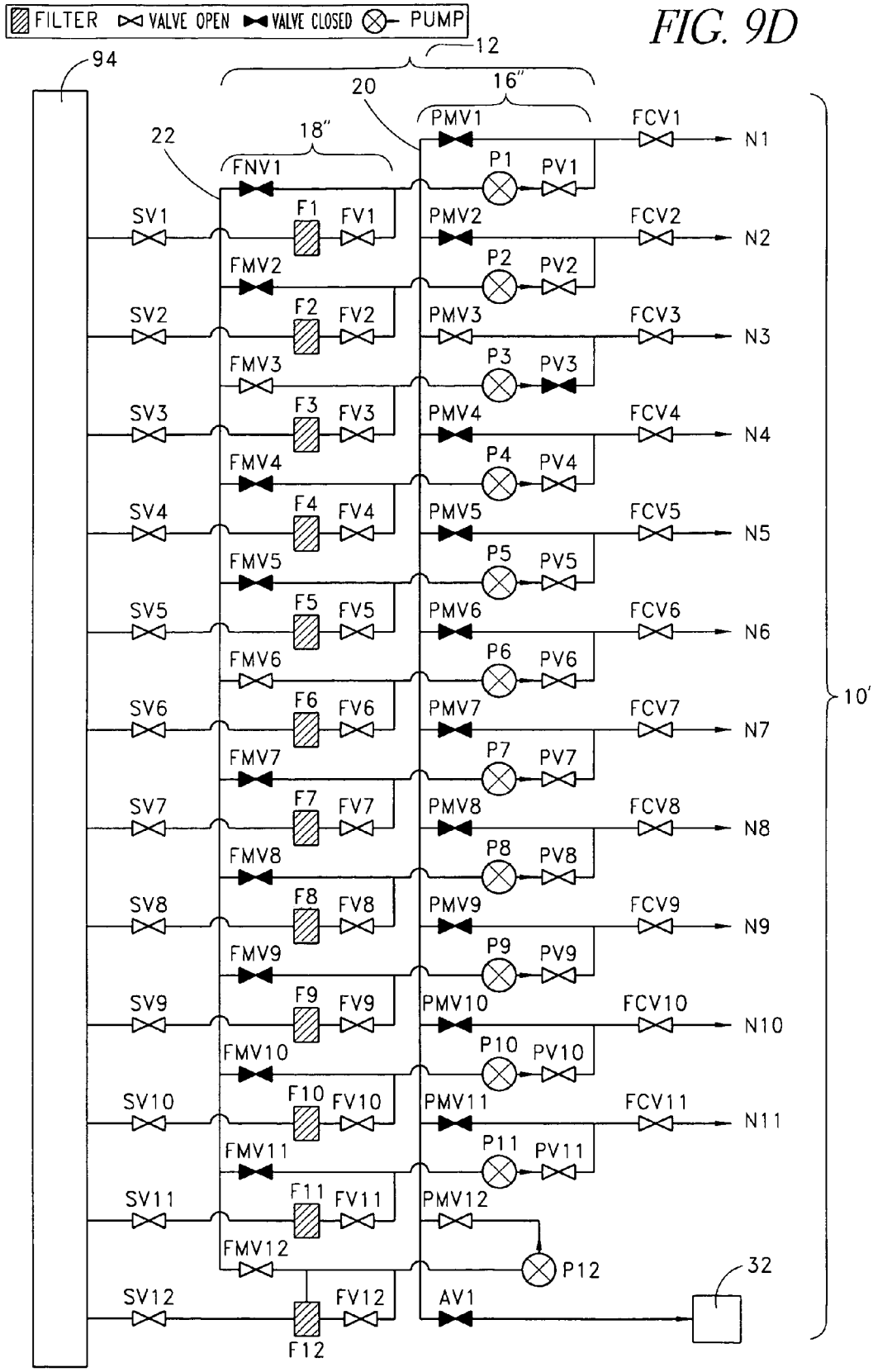

FIG. 9*d* illustrates the situation where both a primary pump (e.g., P3) and primary filter (e.g., F6) need to be serviced or replaced at the same time. In that case, designated auxiliary filter F12 is switched in to make up for the lost filter capacity and designated auxiliary pump P12 is switched in to make up for lost pump capacity. This ensures that the pumping system 10' is able to provide the requisite water supply to nozzles N3 and N7 even when both a primary pump P3 and a non-associated filter F6 are required to be shut down and/or replaced. Procedurally, this is accomplished by closing valve FV6, and opening valves SV12, FMV6, FMV12 and FV12, so that the water flow to nozzle N6 is substantially not disrupted or is only briefly interrupted. At the same time or sequentially (depending upon timing of the malfunctions) primary pump P3 is turned off and designated auxiliary pump P12 is turned on. Valve PV3 is closed, and valves PMV3, FMV3 and PMV12 are opened, so that the water flow to nozzle N3 substantially without being disrupted or being only briefly interrupted.

Again, each of these steps is preferably done automatically, although manual operation of the pumping system 10" in this manner is also effective. In this "P3/F6 bypass" configuration primary pump P6 draws water from the sump 94 through valve SV12, through designated auxiliary filter F12 and valves FV12 and FMV12, through filter bypass manifold 22 and valve FMV6 and provides it to the nozzle N6 under pressure through valve PV6. Auxiliary pump P12 draws water from the sump 94 through valve SV3, through primary filter F3 and valves FV3 and FMV3, through filter bypass manifold 22 and valve FMV12 and provides it to the nozzle N3 under pressure through valves PMV12, pump bypass manifold 20 and valve PMV3. The looping out of primary filter F6 and primary pump P3 and the re-routing of the various water flows is preferably accomplished while the remaining pumps and the ride remains in operation, thus providing advantageous "hot swapping" of the affected components.

When primary filter F6 and/or primary pump P3 are ready to be activated again (after inspection, servicing, repair or replacement) the above-described procedure is simply reversed and designated auxiliary filter F12 and pump P12 are looped out of the pumping system 10" and the water is again re-routed to restore normal operation of the pumping system 10" without shutting down the ride.

Optionally, in any of the above-described embodiments auxiliary pump P12 may also be used to provide pressurized water to an alternate less-critical destination 32, such as a lazy river water ride attraction, a recirculation filter or other non-essential destination. Thus, with the pump manifold valves PMV1 to PMV11 and valve AFV12 closed, the valves SV12, AFV13, APV12 and APV13 may be opened and the pump P12 turned on. The pump P12 then draws water from the sump 94 through valve SV12, filter F12, valve AFV13 and pumps it through valves APV12, pump manifold 20 and valve APV13 to the alternate destination 32.

Figure 10:
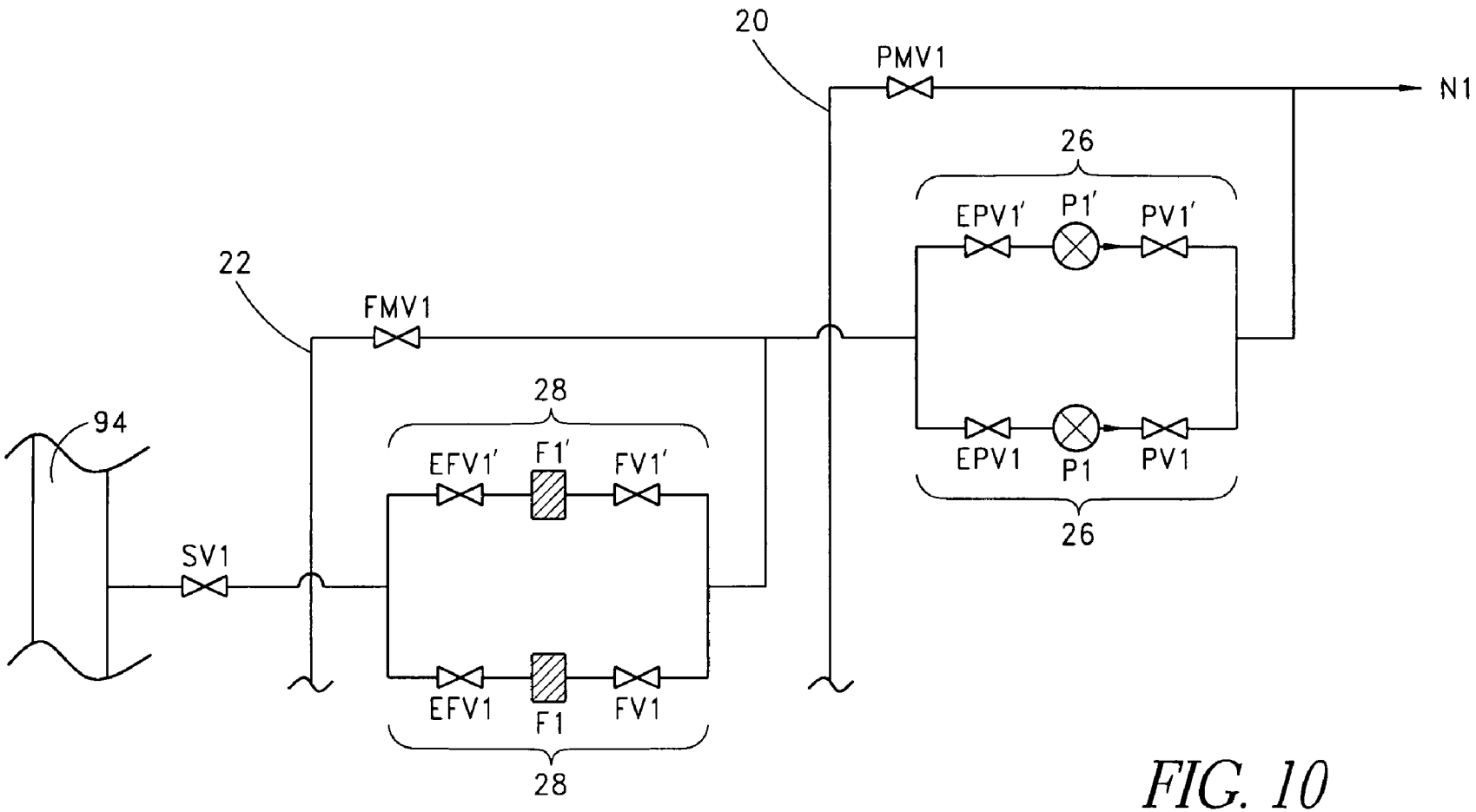
FIG. 10 is a schematic fluid circuit diagram of a further alternative embodiment of a redundant pump and filter array system having features and advantages in accordance with the present invention.

Those of ordinary skill in the art will readily comprehend that the scope of the present invention permits increasing the redundancy level of the hydraulic systems 10, 10', 10" in numerous other ways to achieve significant commercial and practical advantages. Another preferred embodiment is illustrated in FIG. 10. Again, for ease of illustration and brevity of description like elements are designated using like reference numerals and the descriptions thereof are not repeated herein. In this case, and by way of example, the primary pump P1 and valve PV1 of previously described embodiments have been replaced by a parallel pump set-up 26, and the primary filter F1 and valve FV1 have been replaced by a parallel filter set-up 28. Of course, any of the other primary pumps P2 to P11 and auxiliary pump P12, and primary filters F2 to F11 and auxiliary filter F12 may be replaced with such a parallel set-up. This parallel set-up of pumps and filters is desirable if one of the nozzles, for example nozzle N1, supplies water to a very critical section of a water ride. Advantageously, the preferred embodiment illustrated in FIG. 10 provides extra assurance that the flow of water to nozzle N1 will not be interrupted or disrupted.

Referring to FIG. 10 pumps P1 and P1' are arranged in parallel with valves EPV1 and EPV1', respectively, at their respective suction ends and valves PV1 and PV1', respectively, at their respective discharge ends. Similarly, filters F1 and F1' are arranged in parallel with valves EFV1 and EFV1', respectively, at their respective inlets and valves FV1 and FV1', respectively, at their respective outlets. Preferably, these valves are open-close valves of the type mentioned herein above. In typical normal operation, one of the pumps P1, P1' and one of the filters F1, F1' is looped out. For example, pump P1' is looped out by closing valves EPV1' and PV1', and filter F1' is looped out by closing valves EFV1' and FV1'. Of course, during normal operation valves SV1, EFV1, FV1, EPV1 and PV1 are open while valves FMV1 and PMV1 are closed. Thus, water from the sump 94 flows through the filter F1 and is pumped by pump P1 to the nozzle N1.

If pump P1 fails or has to be shut-off, pump P1' can take over the responsibility of providing the requisite water supply to nozzle N1. This is accomplished by turning off pump P1, turning on pump P1', closing valves EPV1 and PV1, and opening valves EPV1' and PV1', thereby isolating pump P1 but without disrupting or interrupting the water flow to the ride. When pump P1 is ready to be turned on again the above-described procedure is reversed and pump P1' is looped out and the water is again routed from pump P1 to the nozzle N1, to restore typical normal operation, all without shutting down the ride. This is accomplished by turning off pump P1', turning on pump P1, closing valves EPV1' and PV1', and opening valves EPV1 and PV1, so that the water flow to the ride is not disrupted or interrupted. Advantageously, the extra redundancy provided by the auxiliary pump P12 (e.g. FIGS. 7–9) will be available if both the pumps P1 and P1' fail or have to be shut-off. In an alternative normal mode of operation, both pumps P1 and P1' may be operated simultaneously at a reduced pumping rate, with each pump having sufficient pumping capacity to independently supply nozzle N1 if one of the pumps P1 or P1' fails or needs to be shut-off.

Similarly, if filter F1 becomes clogged or needs to be replaced, filter F1' can take over the responsibility of filtering the water being supplied to nozzle N1. This is accomplished by closing valves EFV1 and FV1, and opening valves EFV1' and FV1', thereby isolating filter F1 but without disrupting or interrupting the water flow to the ride. When filter F1 is ready to be used again the above-described procedure is reversed and filter F1' is looped out and the water is again routed through filter F1 to the nozzle N1, to restore typical normal operation, all without shutting down the ride. This is accomplished by closing valves EFV1' and FV1', and opening valves EFV1 and FV1, so that the water flow to the ride is not disrupted or interrupted. Advantageously, the extra redundancy provided by the auxiliary filter F12 (e.g. FIGS. 7–9) will be available if both the filters F1 and F1' become clogged or need to be replaced. In an alternative normal mode of operation, both filters F1 and F1' may be used simultaneously.

Referring again to FIG. 10, which shows two pumps P1, P1' in parallel and two filters F1, F1' in parallel, it will be readily apparent to those skilled in the art that any number of pumps or filters may be used in parallel. Additionally, pumps P1 and P1' may be in parallel with a filter connected in series to the parallel pump set-up or filters F1 and F1' may be in parallel and connected to a pump in series. Moreover, a parallel set-up may employ a filter and a pump connected in series on each one of its branches. Those of ordinary skill in the art will readily recognize that many other similar modifications are within the scope of the invention described herein.

Redundant Nozzle Array

As discussed previously, the nozzle system 13 includes plural nozzles N1 to N11 as shown, for example, in FIGS. 7–9. These are positioned at predetermined positions along a water ride (e.g. FIG. 1) to provide the desired transfer of momentum to a rider or ride vehicle and/or to provide other desired ride effects. As with the pump and filters described above, occasionally, it has been observed that one of the nozzles in the water ride will fail or become fully or partially clogged or blocked by a leaf, twig or other debris in the water or on the ride surface. In such case, the nozzle may no longer be able to function at the required capacity and/or to produce the required velocity and volume of water to achieve the desired effect. In such cases, the ride may have to be shut-down for service or repair. But, as noted above, shutting down the ride is an undesirable and disadvantageous situation because ride patrons may become upset or impatient waiting for the ride to be repaired and restarted. Also, patrons on the ride during a forced shut-down may be effectively stranded on the ride for some duration until such time as it can be successfully repaired and restarted. Excessive down-time can lead to lower overall rider throughput and, therefore, reduced profits for the ride owner/operator.

Figure 11:
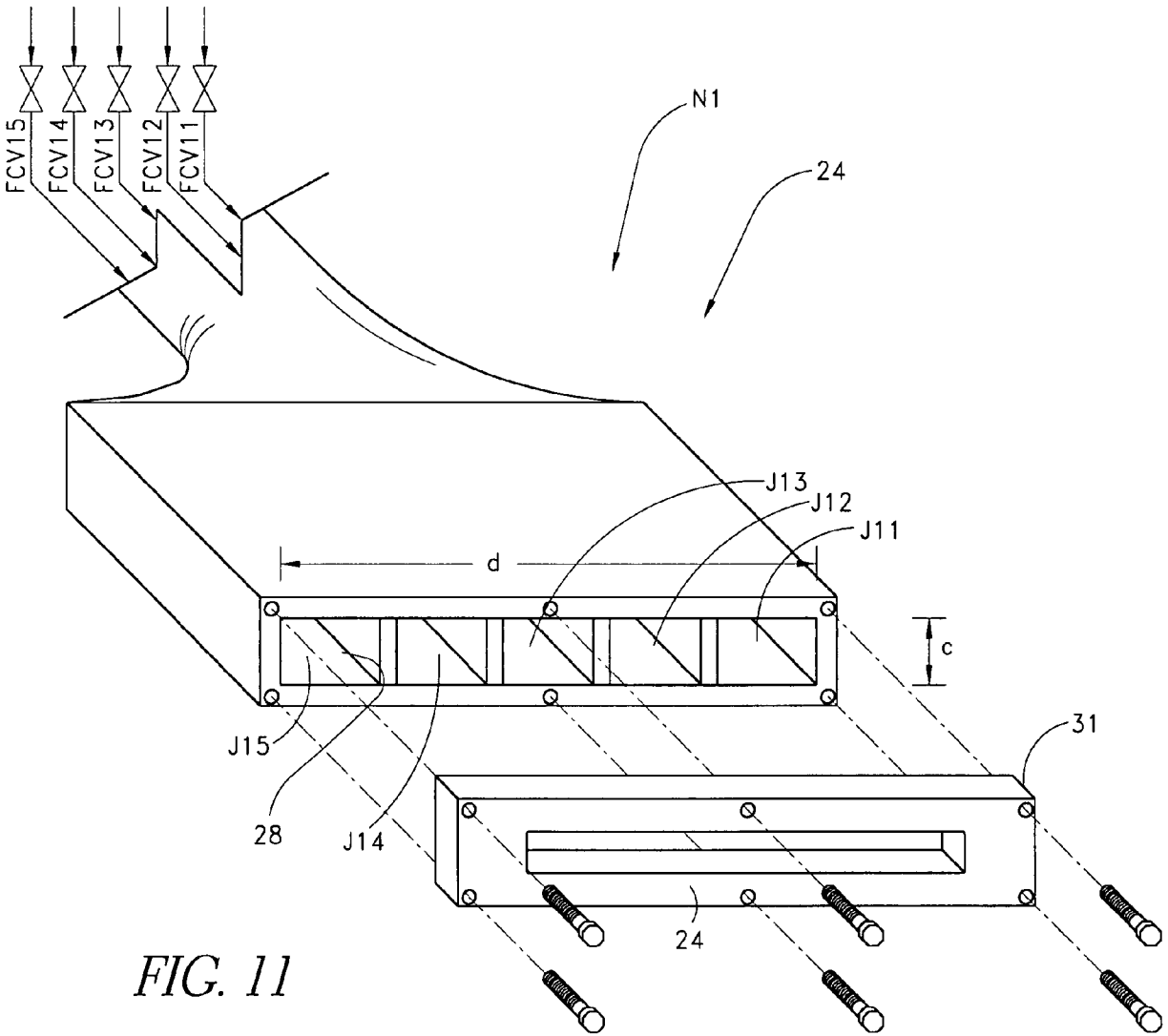
FIG. 11 is a partial schematic perspective view of a redundant nozzle array having features and advantages of the present invention.
Figure 12:
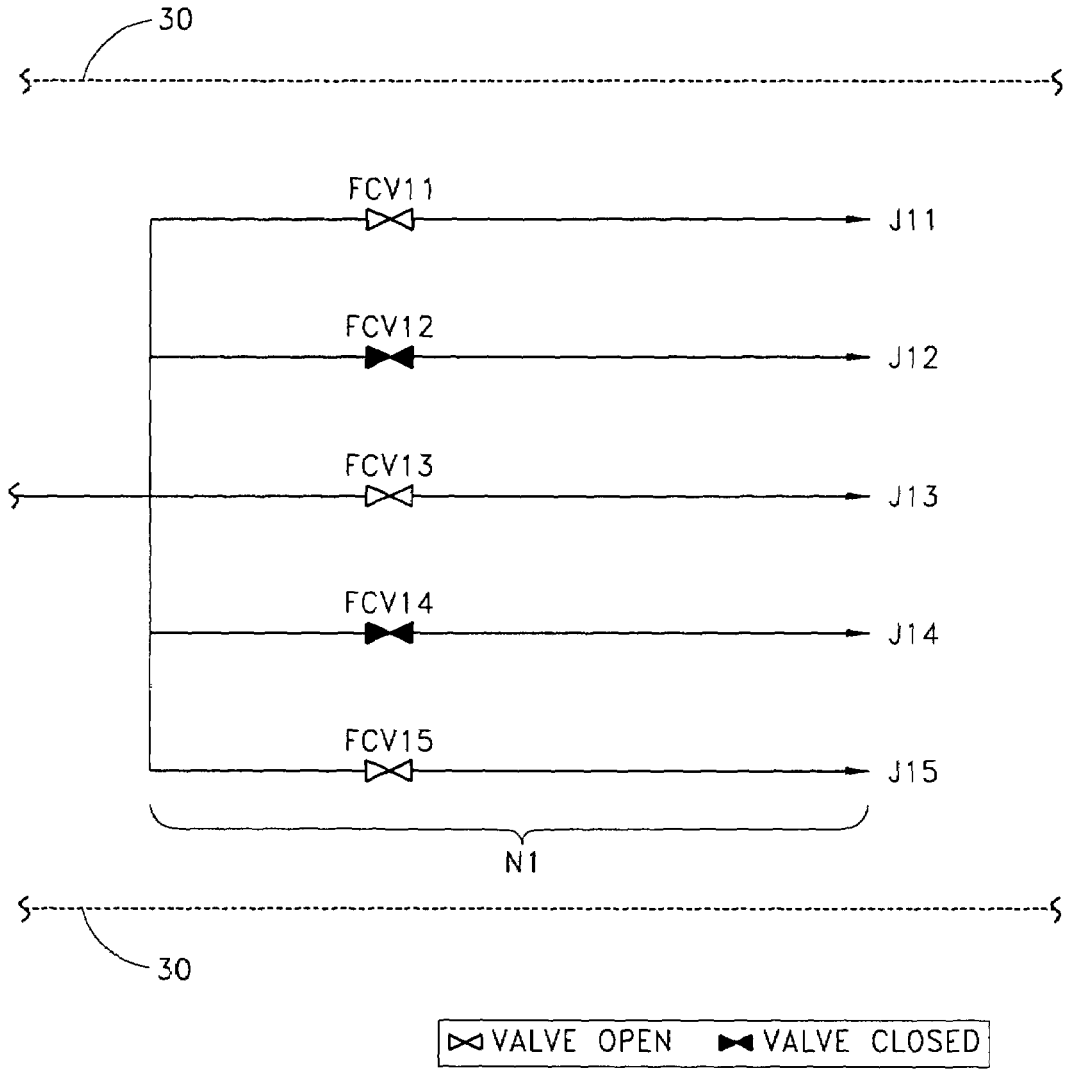
FIG. 12 is a simplified schematic fluid circuit diagram of the redundant nozzle array of FIG. 11.

Accordingly, another feature and advantage of the present invention is to overcome or mitigate these problems by providing a redundant or quasi-redundant nozzle system, such as schematically exemplified in FIGS. 11 and 12. In this embodiment of the present invention the nozzle system 13 is preferably quasi-redundantly configured. That is, one or more of the nozzles N1 to N11 may advantageously composed of a plurality of smaller nozzles or jets, as can be seen schematically in FIGS. 11 and 12 for nozzle N1. Thus, N1 is preferably composed of jets J11, J12, J13, J14 and J15 which are preferably closely spaced and substantially in-line. The quasi-redundantly configured nozzle N1 further includes a plurality of flow control valves FCV11 to FCV15 with each such valve being associated with a respective jet of the nozzles N1. These flow control valves control the amount of water flow through each one of the jets of the nozzle N1. For brevity, only the flow control valves of nozzle N1 are shown in FIGS. 11 and 12, although it may be appreciated that nozzles N2 to N11 may be equivalently constructed. Thus, the amount of water flow through jets J11 to J15 is controlled by the flow control valves FCV11, FCV12, FCV13, FCV14 and FCV15, respectively, which are located upstream of respective jets J11 to J15.

In the preferred embodiment, illustrated in FIGS. 11, 12 the quasi-redundant nozzle N1 has five jets. Of course, the number of jets associated with each quasi-redundant nozzle N1 to N11 may be increased or decreased, as desired or needed. Moreover, each quasi-redundant nozzle N1 to N11 may have a different number of jets associated with it. Preferably, the aperture of the jets of quasi-redundant nozzles N1 to N11 is rectangular in shape though other shapes such as circular, ellipsoidal or polygonal, alone or in series, may be used with efficacy. Preferably, the height of the aperture of each jet can range from about ½ cm to 40 cm and the width can range from about 4 cm to 40 cm. Additionally, the aperture sizes of the jets of a given nozzle, for example, the jets J11 to J15 of quasi-redundant nozzle N1, can be different. Similarly, the apertures of jets of quasi-redundant nozzles N1 to N11 may be differently dimensioned. Also, the aperture size of jets J11 to J15 can be adjusted, for example, as shown in FIG. 11, by employing a bolted aperture plate 24.

Referring to FIGS. 11 and 12, the flow control valves FCV11 to FCV15 associated with the respective jets J11 to J15 of the quasi-redundant nozzle N1 are preferably butterfly valves, though various other types of valves may be used with efficacy including globe valves, angle valves and needle valves among others. Preferably, these flow control valves may be automatically adjusted, such as by electro-mechanical and/or hydro-mechanical actuators, and are chosen and adjusted to provide a balanced jetted flow during normal operation.

In one preferred mode of operation, and as illustrated in FIG. 12, flow control valves FCV11, FCV13 and FCV15 are normally open (conducting, denoted by "white" or "⋈") at the required or desired setting while flow control valves FCV12 and FCV14 are normally fully closed (blocked, denoted by "black" or "⧓"). In this manner, the jets J13 and J15 provide quasi-redundancy to the nozzle N1 and, hence, to the nozzle system 13 by serving in a reserve capacity. Advantageously, the quasi-redundant jets minimize the undesirable effects of fully or partially clogged or blocked jets on a water ride.

For example, and referring to FIG. 12, in case of blockage of one or more of the primary jets J11, J13 and J15 the flow control valves FCV12 and/or FCV14 can be opened to the required setting to allow the needed quantity of water to flow out of reserve jets J12 and/or J14 so as to compensate for the blocked primary jet(s) J11, J13 and J15. The partial or full blockage can be detected by monitoring associated pressure and/or flow sensors (discussed later) Of course, in the case of partial blockage of one or more of the primary jets J11, J13 and J15, adjustment of the flow control valves FCV11, FCV13 and FCV15 independently or in conjunction with the opening of the flow control valves FCV12 and/or FCV14 may be needed. Also, the jet flow control valves may be adjusted in conjunction with a change in the pumping rate. Thus, the quasi-redundancy provided by the reserve jets, for example, the reserve jets J12 and J14 of the quasi-redundant nozzle N1, assists in permitting an associated ride (e.g., FIG. 1) to continue uninterrupted operation even when a jet becomes clogged until required maintenance or repairs of the affected jet(s) can be conveniently performed. Of course, the specific number and configuration of the primary and reserve jets, of all the nozzles N1 to N11, is dependent on the nature of the ride. Also the particular settings of the jet flow control valves, is dependent on the water flow requirements and the degree of the jet blockage.

Figure 13:
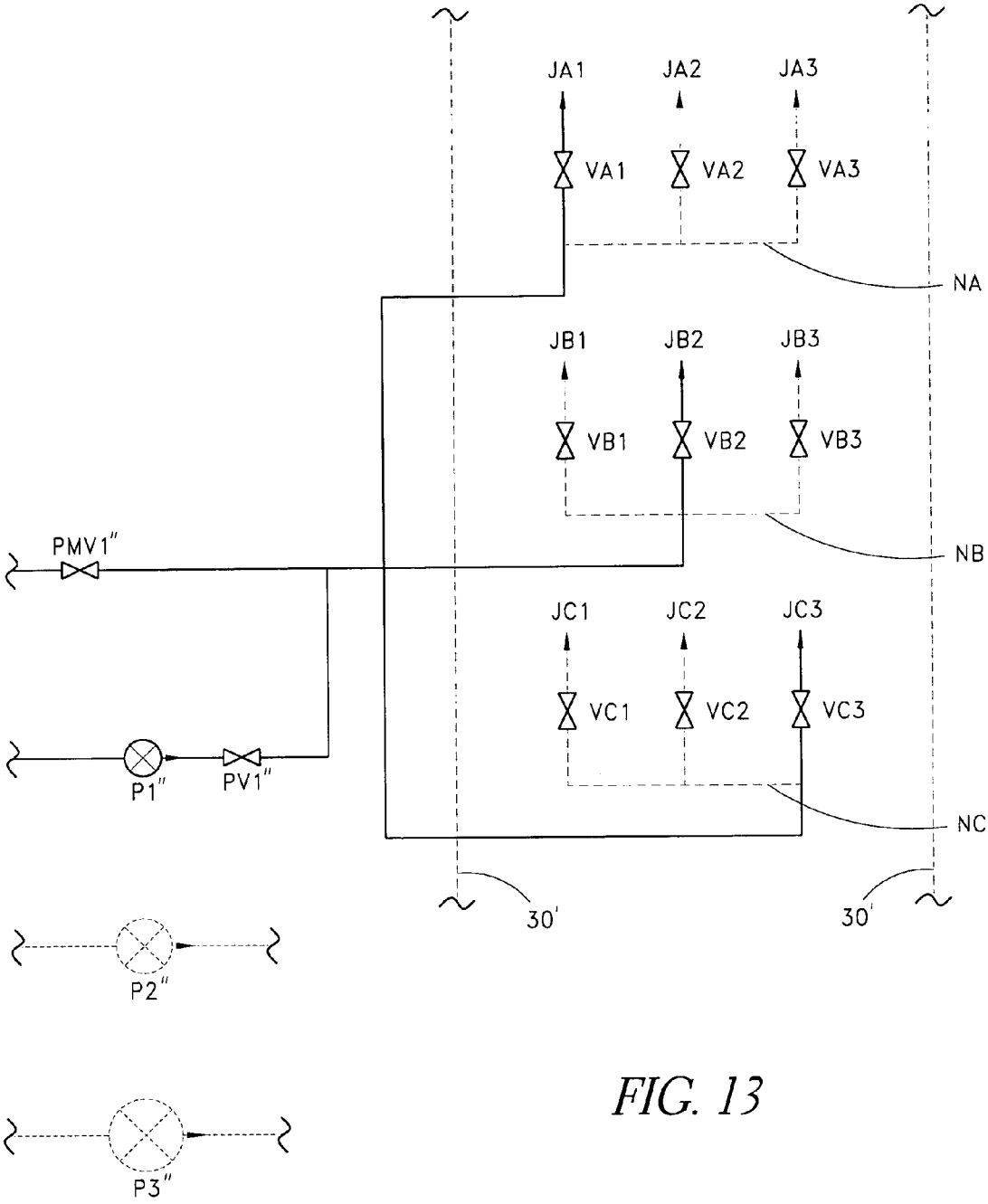
FIG. 13 is a simplified schematic fluid circuit diagram of an alternative embodiment of a redundant nozzle array having features and advantages in accordance with the present invention.

FIG. 13 schematically illustrates another alternative embodiment of a redundant or quasi-redundant nozzle system having additional advantageous features in accordance with the present invention. In the particular embodiment illustrated in FIG. 13, a pump P1" feeds into a plurality of jets with each one of the plurality of jets being part of a separate nozzle. Those of ordinary skill in the art will readily comprehend that this pump-jet configuration can be incorporated into any of the hydraulic pumping systems 10, 10', 10" described above. FIG. 13 shows a pump P1" that feeds into a jet JA1 which is part of a nozzle NA, a jet JB2 which is part of a nozzle NB and a jet JC3 which is part of a nozzle NC. The pump P1" is preferably a primary pump of a hydraulic pumping system 10, 10' or 10" (FIGS. 7–9). The nozzles NA, NB and NC are preferably substantially closely spaced one behind the other along a section 30' of a water ride (e.g., FIG. 1). The flow rate through jets JA1, JB2 and JC3 is controlled by means of respective flow control valves VA1, VB2 and VC3. Similarly, it will be understood that a pump P2" feeds into jets JA2, JB3 and JC1, and a pump P3" feeds into jets JA3, JB1 and JC2 (connections omitted for clarity of drawings). Preferably, the pumps, nozzles, jets and valves of FIG. 13 are of a similar type as discussed herein above.

In normal operation, and referring to FIG. 13, only a certain number (less than all) of the jets will be used. The exact number will depend on the size and nature of the ride and the desired effect. For example, if jets JA1, JA3, JB2 and JC2 are used in normal operation and jet JA1 becomes blocked, then the flow control valves VA2, VB1 and VC1 leading to surrounding jets such as JA2, JB1 and JC1, respectively, can be adjusted, concurrently with an adjustment to the pumping rate of one or more pumps P2", P3", so as to compensate for the reduced water flow out of the blocked jet JA1. Of course, if jet JA1 is only partially blocked an adjustment to its associated flow control valve VA1, independently or concurrently with adjustments to other jet flow control valves, may be sufficient to maintain sufficient aggregate water flow and velocity.

Alternatively, all the jets may be used normally at somewhat less than full flow capacity or velocity. Blockage of any one of the jets could then be compensated by adjusting the other flow control valves to increase their flows. If, for example, jet JB3 is blocked the flow control valves VA3, VB2 and VC3 leading to surrounding jets such as JA3, JB2 and JC3 could be adjusted concurrently so as to compensate for the lack of water flow out of blocked jet JB2. Again, if jet JB2 is only partially blocked an adjustment to its associated flow control valve VB2, independently or concurrently with adjustments to other jet flow control valves, may be sufficient to maintain normal water flow.

Thus, the redundant nozzle array of FIG. 13 provides means to permit a ride to continue uninterrupted operation even when a jet becomes clogged until required maintenance or repairs of the jet(s) can be conveniently performed. Again, the specific number and configuration of the pumps, nozzles and jets, as well as the particular settings of the flow control valves, is dependent on the nature of the ride, the location of the blocked jet(s) and the degree or likelihood of jet blockage.

Pressure and Flow Sensors

Figure 14A:
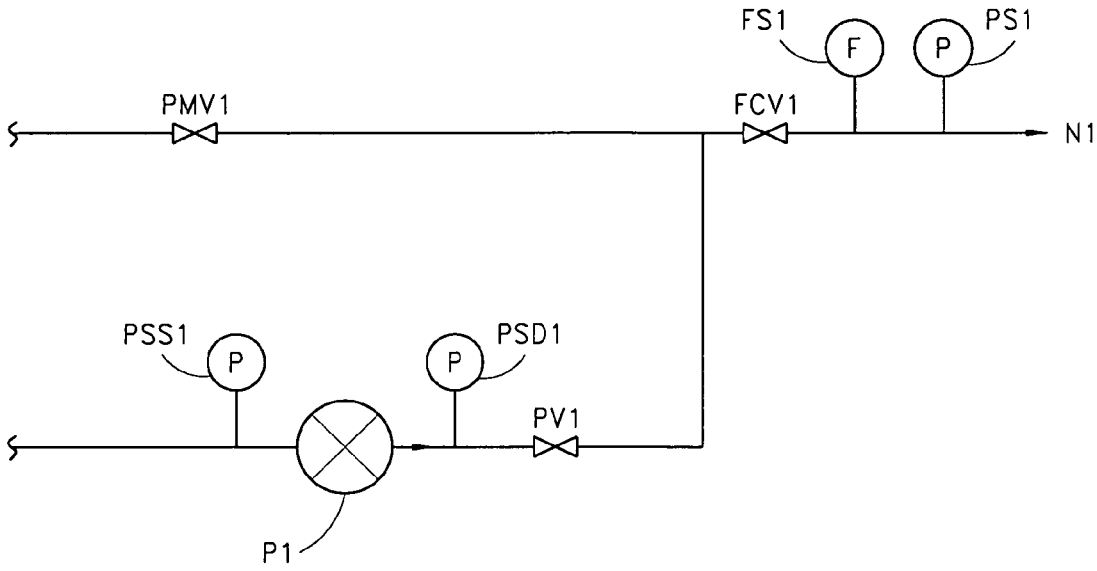
FIGS. 14*a–c* are schematic fluid circuit diagrams of a further alternative embodiment of redundant pump, filter and nozzle array systems having features and advantages in accordance with the present invention, illustrating the use of flow and pressure sensors therein.
Figure 14B:
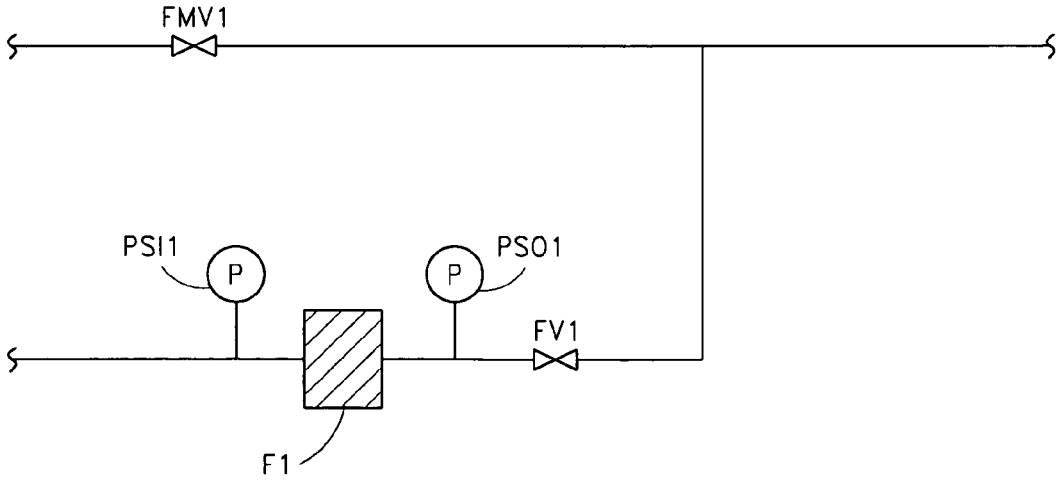
Figure 14C:
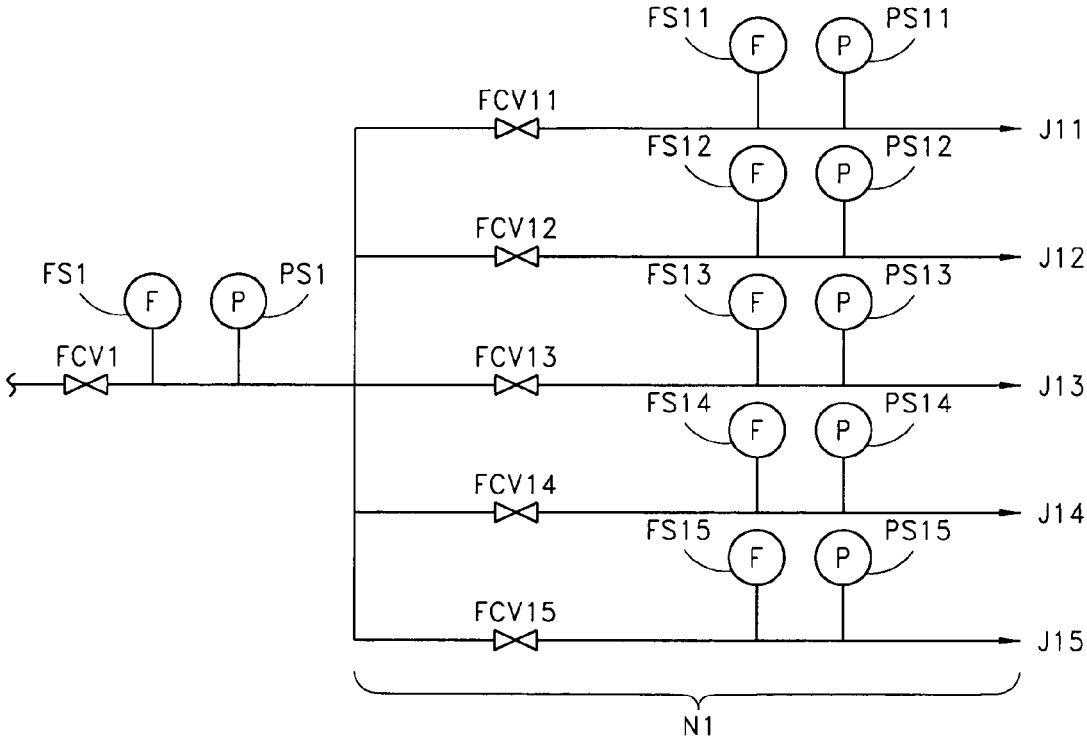

Optionally, in any of the above described redundant pump, filter or nozzle arrays, each operating component in the redundant array may include one or more associated pressure sensors, such as illustrated in FIGS. 14*a–c*. Thus, a pressure sensor PSS1 may be provided on the suction end of pump P1 and a pressure sensor PSD1 may be provided on the discharge end of pump P1, as illustrated in FIG. 14*a*. Advantageously, the pressure sensors PSS1 and PSD1 may be used to monitor the performance of pump P1 and the amount of head generated thereby. Advantageously, this information can be provided to an automated control and diagnostics system, discussed in more detail later, which provides automated diagnosis and "hot swapping" of malfunctioning pumps. Pressure sensors PSS1 and PSD1 may comprise any one of a number of commercially available pressure measuring devices well-known in the art, such as pressure gauges, pressure transducers, strain gauges, diaphragm gauges, and the like.

Similarly, each filter in a redundant filter array may include one or more associated pressure sensors, as illustrated in FIG. 14*b*. Thus, a pressure sensor PSI1 may be provided on the inlet end of filter F1 and a pressure sensor PSO1 may be provided on the outlet end of filter F1. Advantageously, the pressure sensors PSS1 and PSD1 may be used to monitor the pressure drop across each filter F1–F12. Advantageously, this information can be provided to an automated control and diagnostics system, discussed in more detail later, which provides automated diagnosis and "hot swapping" of clogged filters. Pressure sensors PSI1 and PSO1 may comprise any one of a number of commercially available pressure measuring devices well-known in the art, such as pressure gauges, pressure transducers, strain gauges, diaphragm gauges, and the like.

If desired, various sensors may also be provided for monitoring the performance of each of the Nozzles N1–11. For example, each nozzle N1–N11 may include an associated pressure and/or flow sensor, as illustrated in FIG. 14*a*, to monitor the head and flow rate at the inlet of the nozzle. A more sophisticated version of a nozzle sensor system is illustrated in FIG. 14*c*, wherein pressure and flow sensors are provided at the inlet of the nozzle N1 and at the inlets of each of a plurality of jets J11–J15. In each of the embodiments described above, the pressure sensor PS1 may comprise any one of a number of commercially available pressure measuring devices well-known in the art, such as pressure gauges, pressure transducers, strain gauges, diaphragm gauges, and the like. Likewise, the flow sensor FS1 may comprise any one of a number of commercially available flow measuring devices such as rotameters, venturi meters, static pressure probes, pitot tubes, hot-wire meters, magnetic flow meters and mass flow meters among others. Advantageously, the information provided by the pressure sensor(s) and/or flow sensor(s) can be provided to an automated control and diagnostics system to diagnose potential malfunctions and take corrective or compensating measures accordingly. Such a control and diagnostics system is described in more detail below.

Control/Diagnostics System

As noted above, an array of pressure and flow sensors may be provided in association with any one of a number of the various operating components of the redundant pump, filter and nozzle/jet arrays, as desired, so that such components may be advantageously monitored. Such a control and diagnostics system preferably monitors the various active components and automatically takes corrective action. For example, FIG. 15 shows a simplified schematic flow chart logic diagram of one such control/diagnostics system 300 having features and advantages in accordance with the present invention. The control logic and system illustrated and discussed below may be programmed into a suitable PLC, computer or other control or logic circuitry (electronic, hydraulic or otherwise) as is well-known in the art.

The control system starts at step 310, wherein the system queries whether it is safe to start the ride. The query is tested by checking the status of various fault interrupt circuits, operator inputs, key interlocks and the like. If the query is not satisfied, then the system proceeds to step 312 wherein an output signal is generated indicating to the operator that the ride needs to be cleared and any fault interrupt circuits need to be reset or checked.

Assuming that the ride is safe for start-up, the system then proceeds to step 314 and waits for an operator input to start the ride. For example, this input may be a start button, a key interlock or the like. Alternatively, more sophisticated computer control interlocks, remote access controls and the like are also possible and are embraced by the present invention. Once a "start" input is received the system proceeds to step 316, wherein the PLC initiates the main boot-up sequence. In this sequence, the various pumps comprising the ride pumping system are started up in a predetermined sequence and mode, preferably with at least 10 seconds delay between each. Optionally, step 318 enables the operator to adjust the start-up mode and/or to identify the particular pumps selected for operation via a switchboard or other input interface.

Once the various pumps are started at step 316, the PLC queries the various pressure and flow sensors (described above) at step 320. This data (or digested/processed data) is also outputted to a display screen or a remote data access port (step 324) wherein it may be monitored by an operator. This may be provided to a remote monitoring station, for example, via internet or direct modem connection. Thus, if the operator should detect or observe that a sensed condition, such as pressure or flow rate, indicates a problem with an operating component of the ride system, the operator can diagnose the problem and take corrective measures such as looping the affected component(s) out of the pumping system and servicing and/or repairing it. Optionally, the PLC may be programmed to automatically diagnose certain fault conditions, such as a failed pump, and to take corrective measures automatically by sending an appropriate actuation signal(s) to one or more remote actuated valves (described above).

The PLC also routinely monitors a series of fault interrupt circuits, such as emergency "kill" switches and the like, which may be provided at various points along a ride. These may be actuated by one or more operators who monitor the ride and ensure the safety of ride participants thereon. If the ride malfunctions or if a rider is behaving recklessly, for example, the observing operator could hit a kill button to shut down the ride or a portion thereof so he can take appropriate corrective action. In the logic diagram illustrated in FIG. 15, three such "kill" switches are provided at steps 326, 328 and 330, corresponding to designated zones 1, 2 and 3 of the ride. If any of the fault conditions 326, 328 and 330 occur, then pumps are progressively stopped in each of the zones 1, 2 and 3, according to steps 336, 338 and 340, respectively. If no fault conditions are present, then the system reaches step 342 and thereafter continues to loop through the various steps.

Optionally, those skilled in the art will readily recognize that more sophisticated sensors and logic programming may advantageously be used, such as rider position sensors, velocity sensors and the like. Such sensors may be used, for example, to monitor rider velocity and spacing between successive riders at critical portions of the ride to ensure optimal safety and rider throughput. Position sensors could also be used to trigger intermittent operation of various injection nozzles so that they operate only when a rider is present, for example. This could result in significant energy and costs savings. Additional useful inputs/outputs and system functions are listed in TABLE 1 below:

TABLE 1

| Control Inputs/Outputs/Functions |
|---|
| Sensor Inputs |
| P Pressure Transducer before strainer basket |
| P Pressure Transducer after strainer basket |
| P Pressure Transducer at pump discharge |
| P Pressure Transducer at nozzle |
| F Flow Transducer |
| L Position Sensors (Proximity or Photo Eye) as required on slide path |
| A Ammeter |

TABLE 1-continued

| Control Inputs/Outputs/Functions |
|---|
| Advisory Outputs to Operator |
| Notification to clean strainers |
| Rider location in ride (by zone) |
| Rider speed at specific locations |
| Alert that rider has stopped (by zone) |
| Fault indication in case of automatic shutdown |
| Signal clear to launch |
| Functional Outputs (Automatic Controls) |
| Sequence pump starters on "Start" command |
| Auto shut down in case of rider stoppage or E-Stop activation |
| Control Variable Speed Motor Drives to Optimize performance and save energy |
| Slow pump motors until rider approaches nozzle |
| Increase pump speed to compensate for dirty strainers or other conditions |
| Activate fiber optic light effects in closed ride sections as riders approach |
| Statistics and Diagnostics |
| Rider count (cumulative over any period) |
| Rider speed (individual or average over any period) |
| Ride time (last to average) |
| Number of ride stoppages and cause of each |
| Total uptime or downtime |
| Histograms of all pressures and flows |
| Energy consumption (peak, current and cumulative) |
| All information available via local computer screen or modem connection |

The above-described control and diagnostics system also lends itself well to remote recording and monitoring of data so that ride operations can be improved and refined using actual data from operating ride attractions.

Those skilled in the art will readily recognize the utility and advantages of the present invention. Though the various preferred embodiments have been described in conjunction with specific embodiments, those skilled in the art will recognize that the invention can be practiced in a wide variety of different embodiments all having the unique features and advantages described herein. Thus, while the present invention has been described with a certain degree of particularity, it is manifest that many changes may be made in the specific designs and constructions herein-above described without departing from the spirit and scope of this disclosure. It is understood that the invention is not limited to the embodiments set forth herein for purposes of exemplification, but is to be defined only by a fair reading of the appended claims, including the full range of equivalency to which each element thereof is entitled by law.

What is claimed is:

1. A hydraulic system for a water ride, comprising:

a first and a second primary pump;

a first and a second supply conduit, the first primary pump hydraulically connected to the first supply conduit, the second primary pump hydraulically connected to the second supply conduit so that the primary pumps deliver pressurized water to the corresponding conduits;

an auxiliary pump;

a pump bypass manifold; and a plurality of valves arranged relative to the pumps and manifold so that, through selective actuation of the valves, the first primary pump can selectively be disconnected from the corresponding first conduit and in its place the auxiliary pump can be selectively connected via the pump bypass manifold to the first conduit so that the auxiliary pump delivers pressurized water to the first conduit in place of the first primary pump.

2. A hydraulic system as in claim 1 additionally comprising a first primary filter, a second primary filter, an auxiliary filter, a filter bypass manifold, and a plurality of valves, wherein the first primary filter is in a series arrangement with the first primary pump and the second primary filter is in a series arrangement with the second primary pump.

3. A hydraulic system as in claim 2, wherein the primary filters are arranged upstream of the primary pumps.

4. A hydraulic system as in claim 2, wherein the valves are arranged relative to the filters and filter bypass manifold so that, through selective actuation of the valves, the first primary filter can selectively be removed from the series connection with the corresponding first primary pump and in its place the auxiliary filter can be selectively connected via the filter bypass manifold in a series arrangement with the first primary pump.

5. A water ride attraction, comprising the hydraulic system as in claim 1 and a ride surface having a start point and an end point, wherein each conduit directs water to a corresponding outlet on or adjacent a ride surface.

6. A water ride attraction as in claim 5, wherein at least one of the supply conduits is adapted to direct water to a plurality of outlets.

7. A water ride attraction as in claim 5, wherein a first outlet is nearer the start point along the ride surface than is a second outlet.

8. A water ride attraction as in claim 7 additionally comprising a control system configured to control the supply of pressurized water to the outlets, wherein the control system is configured to stop the flow of water to the first outlet before stopping the flow of water to the second outlet upon shutdown of the water ride attraction.

9. A water ride attraction as in claim 8 additionally comprising a plurality of spaced apart rider position sensors at or adjacent the ride surface, the rider position sensors configured to detect a rider position and communicate rider position data to the control system.

10. A water ride attraction as in claim 9, wherein during shutdown of the ride attraction the control system is configured to stop the flow of water to the outlets only after a detected rider has passed the corresponding outlet.

11. A water ride attraction as in claim 10, wherein the ride surface has at least one downwardly inclined portion and at least one upwardly inclined portion, and at least one upward accelerator is configured to propel a rider up the at least one upwardly inclined portion.

12. A water ride attraction as in claim 11, wherein the upward accelerator comprises an outlet comprising at least one water jet adapted to direct a jet flow of water at or adjacent the ride surface generally in a direction of riding.

13. A water ride attraction as in claim 12, wherein at least one water outlet is positioned at or adjacent the at least one downwardly inclined portion.

14. A water ride attraction as in claim 7 additionally comprising a control system configured to control the supply of pressurized water to the outlets and comprising a plurality of spaced apart rider position sensors at or adjacent the ride surface, the rider position sensors configured to detect a rider position and communicate rider position data to the control system.

15. A water ride attraction as in claim 14, wherein the control system is configured to slow the flow of water to the first outlet when there is no rider at or adjacent the first outlet.

16. A water ride attraction as in claim 14, wherein the water ride additionally comprises a substantially enclosed portion comprising a lighting effect, and wherein the control system is configured to activate the lighting effect as a rider approaches the enclosed portion.

17. A hydraulic system as in claim 1, wherein the system comprises N primary pumps and x auxiliary pumps, and each auxiliary pump is arranged to selectively replace any one of the primary pumps.

18. A hydraulic system as in claim 17 additionally comprising N supply conduits, and each of the primary pumps is hydraulically connected to a corresponding one of the supply conduits.

19. A hydraulic system as in claim 18, wherein at least one conduit is adapted to deliver water to a second water ride that is spaced from the first water ride.

20. A hydraulic system as in claim 17 additionally comprising a plurality of supply conduits, and each of the primary pumps is hydraulically connected to at least one corresponding supply conduit, but is not hydraulically connected to each of the plurality of conduits.

21. A water ride attraction, comprising:

a ride surface having a start point and an end point;

a plurality of outlets disposed at or adjacent the ride surface, the outlets being spaced apart from each other along the ride surface;

a source of water;

a plurality of flow paths from the source of water to the outlets;

a redundant pump system interposed in the plurality of flow paths, the pump system adapted to provide pressurized water to the plurality of outlets;

a redundant filter system interposed in the plurality of flow paths; and a plurality of conduits extending from the pump system to respective outlets;

wherein the pump system, filter system and outlets are configured in series such that all water delivered from the source to the ride surface flows through both the redundant filter system and the redundant pump system in the flow paths between the source and the outlets.

22. A water ride attraction as in claim 21, wherein the redundant pump system comprises a plurality of primary pumps and at least one auxiliary pump, and each primary pump is arranged to deliver pressurized water to at least one corresponding conduit.

23. A water ride attraction as in claim 22, wherein the redundant pump system additionally comprises a pump bypass manifold and a plurality of valves, the manifold and valves configured so that a primary pump can be selectively disconnected from the corresponding at least one conduit and an auxiliary pump can be selectively connected via the manifold to the at least one conduit so that the auxiliary pump can effectively replace the primary pump.

24. A water ride attraction as in claim 23, wherein the redundant filter system comprises a plurality of primary filters and at least one auxiliary filter, and each primary filter is arranged in series with at least one corresponding pump.

25. A water ride attraction as in claim 24, wherein the redundant filter system additionally comprises a filter bypass manifold and a plurality of valves, the manifold and valves configured so that a primary filter can be selectively disconnected from its flow path and an auxiliary filter can be selectively connected via the manifold into a series arrangement with the at least one corresponding pump conduit so that the auxiliary filter can effectively replace the primary filter.

26. A water ride attraction as in claim 21 additionally comprising a control system configured to control the supply of pressurized water to the outlets, and wherein a first outlet is nearer to the start point than is a second outlet, and the control system is configured to stop the flow of water to the first outlet before stopping the flow of water to the second outlet upon shutdown of the water ride attraction.

27. A water ride attraction as in claim 21 additionally comprising a control system configured to control the supply of pressurized water through the outlets, and further comprising a plurality of spaced apart rider sensors adapted to detect a position of a rider on the ride surface and communicate rider position data to the control system, wherein the control system controls the supply of water through the outlets based upon rider position data.

28. A water ride attraction as in claim 27, wherein the control system slows water flow to an outlet until a rider is approaching the outlet.

29. A water ride attraction as in claim 28, wherein at least one of the conduits comprises a flow control valve, and the control system controls water supply by controlling the flow control valve.

30. A water ride attraction as in claim 28, wherein the control system controls water supply to an outlet by controlling the speed of a pump corresponding to the outlet.

31. A water ride attraction, comprising a ride surface having a start point and an end point, the ride surface having at least one downwardly inclined portion and at least one upwardly inclined portion;

a plurality of nozzles adjacent the ride surface, the nozzles being spaced apart from one another along the ride surface, at least one of the nozzles being disposed at or adjacent the at least one downwardly inclined portion of the ride surface;

a plurality of pumps configured to deliver pressurized water to the plurality of spaced apart nozzles;

at least one upward accelerator configured to propel a rider up the at least one upwardly inclined portion;

a plurality of spaced apart rider position sensors adapted to detect the position of a rider progressing over the ride surface;

a control system adapted to control operation of the at least one upward accelerator, the control system receiving input from the rider position sensors and being configured to intermittently control the at least one upward accelerator to operate only when a rider is at or near the upward accelerator.

32. A water ride attraction as in claim 31, wherein the upward accelerator comprises a nozzle adapted to inject a jet water flow onto the ride surface.

33. A water ride attraction as in claim 31, wherein the control system is adapted to control operation of the plurality of nozzles, and wherein the control system is configured to intermittently control at least one of the nozzles to operate only when a rider is at or near the nozzle.

34. A water ride attraction as in claim 33 additionally comprising a hydraulic system comprising the plurality of pumps arranged in a redundant pumping system, the plurality of nozzles, and a redundant filter system, wherein all water entering the hydraulic system flows from a source of water through a filter, a pump, and a nozzle that are arranged in series and on to the ride surface.

35. A water ride attraction as in claim 34, wherein each of the pumps are coupled by a manifold, and additionally comprising a plurality of valves configured to selectively place each of the pumps into or out of communication with the manifold.

36. A water ride attraction as in claim 34, wherein the upward accelerator comprises a nozzle adapted to inject a jet water flow onto the ride surface.

37. A water ride attraction as in claim 31, wherein a first nozzle is nearer the start point along the ride surface than is the upward accelerator, and wherein the control system is configured to stop the flow of water to the first nozzle before stopping operation of the upward accelerator upon shutdown of the water ride attraction.

38. A water ride attraction as in claim 37, wherein the upward accelerator comprises a nozzle adapted to inject a jet water flow onto the ride surface.

* * * * *